US007828703B1

(12) United States Patent
Boesch

(10) Patent No.: US 7,828,703 B1
(45) Date of Patent: Nov. 9, 2010

(54) PORTABLE EXERCISE DEVICE

(76) Inventor: Don E. Boesch, 7575 Katy Freeway, No. 78, Houston, TX (US) 77024

( * ) Notice: Subject to any disclaimer, the term of this patent is extended or adjusted under 35 U.S.C. 154(b) by 99 days.

(21) Appl. No.: 12/398,036

(22) Filed: Mar. 4, 2009

Related U.S. Application Data

(60) Provisional application No. 61/034,924, filed on Mar. 7, 2008.

(51) Int. Cl.
*A63B 21/008* (2006.01)
*A63B 21/06* (2006.01)

(52) U.S. Cl. ..... 482/112; 482/93

(58) Field of Classification Search ..... 482/20–22, 482/44–50, 81–82, 92–94, 98–99, 105, 109–112, 482/139, 148; 473/138–139, 147, 207, 212, 473/219, 256, 354, 423–424, 437, 457, 593, 473/603, 609–611
See application file for complete search history.

(56) References Cited

U.S. PATENT DOCUMENTS

| | | | | |
|---|---|---|---|---|
| 2,307,905 | A * | 1/1943 | Ament | 119/708 |
| 2,918,282 | A * | 12/1959 | Waterval | 482/94 |
| 2,944,817 | A * | 7/1960 | Stiller | 473/424 |
| 5,037,087 | A * | 8/1991 | Roth | 482/93 |
| 6,551,222 | B1 * | 4/2003 | Beaver | 482/82 |
| 2009/0247372 | A1 * | 10/2009 | Borth et al. | 482/82 |

OTHER PUBLICATIONS 3-page excerpt from thera-band.com website (printed Dec. 28, 2009) illustrating prior art resistive exercise bands and tubes.
7-page excerpt from aquabells.com website (printed Dec. 28, 2009) illustrating prior art water-fillable exercise dumbells and ankle weights.
Fig. 1 (Prior Art) set forth in the present application and discussed in, e.g., paragraph [0005] (1 page).
47-page excerpt from tackimac.com website (printed Dec. 28, 2009) illustrating prior art grips.
1-page excerpt from babolat.com website (printed Feb. 25, 2008) illustrating the prior art Smart Grip technology.

(Continued)

*Primary Examiner*—Loan Thanh
*Assistant Examiner*—Oren Ginsberg
(74) *Attorney, Agent, or Firm*—Gordon G. Waggett, P.C.

(57) ABSTRACT

The present invention provides a compact, portable, centripetal force-driven exercise device. The device employs a handle equipped with a rotational member. One end of a strap is attached onto the rotational member; the other end to a soft bag. The soft bag, preferably of a heavy duty cloth or synthetic fiber construction, is capable of holding one or more water-refillable, reclosable plastic bags. The strap can have adjustable length. The soft bag itself is also capable of being filled with a desired amount of water. The handle preferably is covered on its exterior surface with a hand grip material. The user places the desired amount of contained water weight into the soft bag, holds the handle and swings the bag in an orbital pattern at a desired number of revolutions per minute to achieve the desired degree of centripetal force resistance to exercise, strengthen and condition the user's muscular system.

11 Claims, 12 Drawing Sheets

OTHER PUBLICATIONS 5-page excerpt from entertainment.how.stuffworks.com website (printed Dec. 28, 2009) illustrating prior art methods for re-gripping a golf club.

7-page excerpt from kmsinc.thomasnet.com website (printed Feb. 22, 2008) illustrating various prior art connectors offered by Keystone Manufacturing.

6-page excerpt from bosunsupplies.com website (printed Feb. 22, 2008) illustrating various prior art connectors offered by Bosun Supplies.

5-page excerpt from castercity.com website (printed Jan. 3, 2008) regarding selection of casters.

2-page excerpt from casterconnection.com website (printed Jan. 28, 2008) illustrating various prior art castors.

67-page Shepherd caster catalog from (printed Jan. 28, 2008) illustrating various prior art connectors (available on-line at nationalcaster.com/shepherd.htm.

2-page excerpt from castersupply.com website (printed Feb. 22, 2008) illustrating various prior art castors.

1-page excerpt from servicecaster.com website (printed Jan. 28, 2008) illustrating the Shepherd Regent Grip Neck Stem model prior art caster (obtained from servicecaster.com/Shepherd_Catalog/regent_grip_neck_stem.PDF).

4-page excerpt from sdhd.manufacturer.globalsource.com website (printed Feb. 22, 2008) illustrating various prior art connectors offered by Shandong Machinery.

* cited by examiner 32
33A
23
21B
21D
21E
21
21B 32
21D
33A
21E
21B 32
21D
33A
21F
21E
21B 24
36
37
35B
35
35A
30
34
31
33
32
21
23
25A
39A
26
21A
24A
22

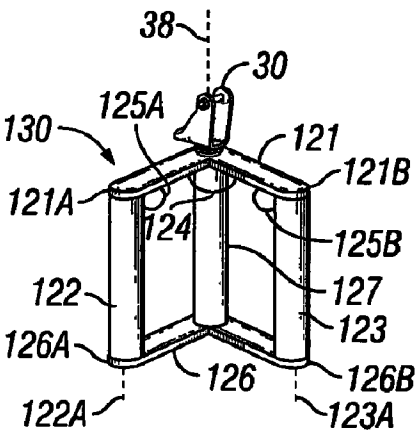
FIG. 12A
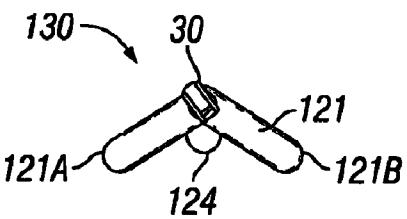
FIG. 12B
FIG. 13A
FIG. 13B
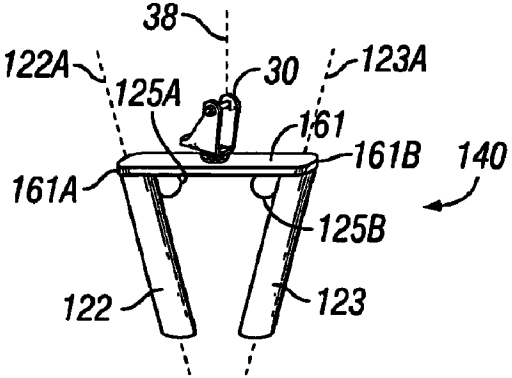
FIG. 14A
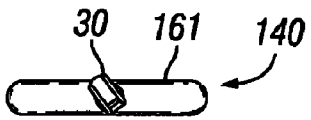
FIG. 14B

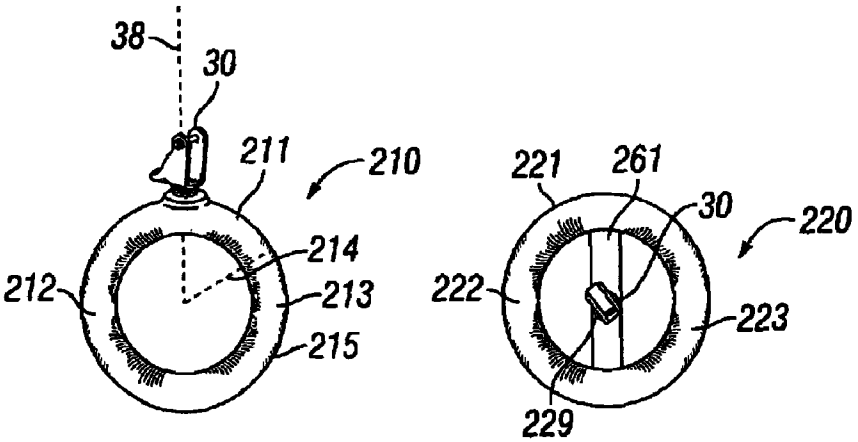
FIG. 21A
FIG. 22A
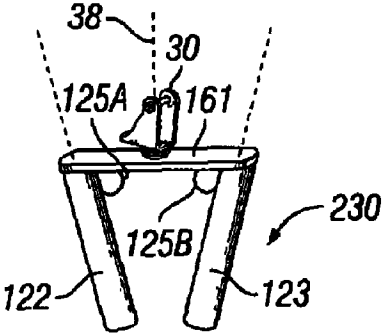
FIG. 23A
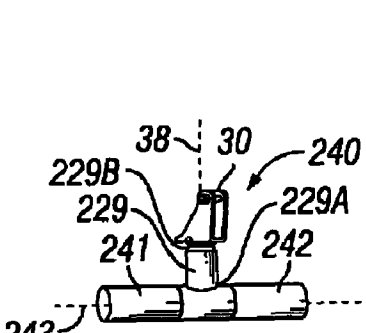
FIG. 24
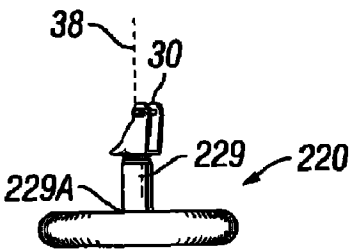
FIG. 21B
FIG. 22B
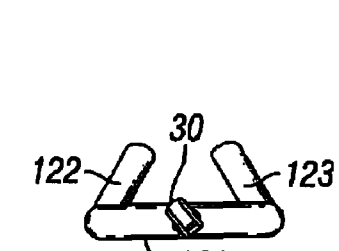
FIG. 23B
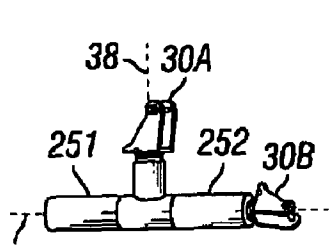
FIG. 25

PORTABLE EXERCISE DEVICE

CROSS-REFERENCE TO RELATED APPLICATIONS

This application claims the benefit of the filing date of and priority to U.S. Provisional Application Ser. No. 61/034,924 entitled "Portable Exercise Device" and filed Mar. 7, 2008, Confirmation No. 8135. Said provisional application is incorporated by reference herein.

STATEMENT REGARDING FEDERALLY SPONSORED RESEARCH OR DEVELOPMENT

Not Applicable.

BACKGROUND OF THE INVENTION

The present invention is directed generally to an improved portable exercise device employing weight resistance for use in connection with overall fitness, strengthening and conditioning, and physical therapy.

BACKGROUND ART

The benefits of exercise are well known for an individual's health, well-being, fitness and physical therapy. While there exist many fitness gyms where one can go to use a variety of exercise machines for a variety of purposes, and while there exist a multitude of large exercise devices available for home use, there also exists a need to have an exercise device employing weight resistance that can be used at home, work or in any other location, and that is readily portable so that it can be easily carried from place to place to permit an individual to have access to this exercise device in any desired location. Additionally, there exists the need to have a versatile exercise device that can be used by anyone, from young age to elderly, regardless of their initial health or physical condition.

Some portable fitness devices known in the art include simple elastic tubes or bands for providing resistance training for e.g., physical therapy. Exemplary resistance training bands of this type are sold under the THERA-BAND® brand by The Hygienic Corporation, and its website thera-band-.com.

Other portable fitness devices known in the art include water inflatable dumbbell weights, such as the AQUA-BELLS® brand of travel dumbbell weights offered through the website aquabells.com that can be emptied, carried empty, and then re-filled with water at a desired location to provide a degree of weighted dumbbells for exercise, physical therapy and/or weight training. According to the manufacturer, a typical set of dumbbells in this AQUABELLS® brand travel dumbbell weight system weighs about 26 ounces empty, and can provide up to 16 lbs of resistance per dumbbell.

Additionally, referring to FIG. 1, there exists an exercise device 1 known to the inventor and in limited use that provides a turned wooden handle 2 outfitted at one end with a swivel connection comprising a caster-type mechanism 3 without the wheel, a rope 4 looped to the swivel connection 3, via braided loop 5 and at the other end of the rope 4, a 1-gallon milk jug or finable can/container 7 (shown empty) is attached via braided loop 6. The container 7 can be filled with water through its top 8. The caster-type mechanism 3 typically utilizes one or more rows of ball bearings 3B and is attached to the handle 2 by gluing (with epoxy) the caster stem 3A into a drilled-out end 2A of the wooden handle 2. In this device 1, which is presently thought by the inventor to be characterizable as prior art, the user (not shown) holds the handle 2 with two hands and swings the container 7, filled with a desired amount of water (not shown), around in an orbital pattern above his or her head. The amount of weight in the container 7 can be adjusted by adding or subtracting water from the container 7. However, this device does not lend itself to portability because of the bulk of the container 7 and also presents a risk of injury if another person is impacted by this type of rotating water-filled container 7. However, the health benefits of using such a circular motion, weight-bearing exercise device remain. Therefore, there exists a need to create an improved, circular motion, weight-bearing exercise device.

BRIEF SUMMARY OF THE INVENTION

To address the forgoing desires, the present invention provides a compact, portable, centripetal force-driven exercise device. The device comprises a handle having one end equipped with a rotational attachment. In a preferred embodiment, the rotational attachment, or rotator, is a caster-type mechanism having a fixed end interfaced with a rotating end by means of a bearing seal, e.g., ball bearings. A first end of a strap is clipped or otherwise attached onto the rotational attachment. The second end of the strap provides another clip or mechanism for attaching a soft bag. The soft bag, preferably of a cloth or synthetic fabric construction, is capable of holding one or more water-refillable plastic bags. The soft bag can employ internal vertical partitions to house smaller water-refillable plastic bags. In a preferred embodiment, the strap is of an adjustable length. In another preferred embodiment, the soft bag is outfitted with two metal circular grommets (e.g., brass) on opposed top edges of the sides of the soft bag, the grommets capable of receiving the strap clip. In yet another embodiment, the soft bag has its own carrying handle or handles that can be attached to the strap clip to fasten the soft bag to the strap. When the strap clip is clipped through the grommets, it serves to close the soft bag opening thereby containing the water-refillable plastic bag(s) within the soft bag. In a preferred embodiment, the water-refillable plastic bag(s) are equipped with a resealable opening to permit containment of the water in sealed fashion, and emptying of the water after use. In another preferred embodiment, the water-refillable plastic bags are reclosable bags of the type such as a zipping lock or sliding lock variety. In another preferred embodiment, the soft bag itself is capable of being filled with a desired amount of water, and can itself, if desired, be outfitted with a reclosable seal such as of the zipping lock or sliding lock variety. In yet another preferred embodiment, the handle comprises a hollow or solid core shaft (of metal, plastic, composite, graphite or other suitable material), and is preferably covered on its exterior surface with a hand grip material. Preferably, the hand grip material is of the tacky rubber variety, but leather or cloth grips, or other grip technologies could also be employed to advantage.

The handle can be ergonomically designed to provide enhanced hand and wrist alignment and improved grip. The handle can be linear (such as with the shaft embodiment), angular, circular, semicircular or other configuration depending on the desired grip configuration. The handle designs can include those that require the user to hold the handle with one hand over the other hand in a vertical, coaxial grip (like a with a golf club or baseball bat), with one hand next to the other hand in a horizontal, coaxial grip (like one might grasp a horizontal chin-up or pull-up bar where the user's palms are either facing away from or toward the user), in a parallel grip (where the palm of one hand is generally facing the palm of the other hand), and in other handle configurations where the user's grip axis are horizontal, vertical, parallel, coaxial, non-horizontal, non-vertical or variations thereof. Preferably, the water-filled zippered plastic bags will readily burst open upon impact thereby minimizing any injury to person or property owing to such impact.

In one embodiment of the present invention there is described a portable, centripetal force-driven exercise device comprising: a handle capable of being gripped by a user; a rotating member fixably attached to the handle and having an axis of rotation; a strap member having a first strap end attached to the rotating member and a second strap end opposite the first strap; and an external bag member capable of being attached and detached from the second strap end, and capable of receiving one or more liquid containers capable of receiving and holding water therein, and capable of releasing said water therefrom. This exercise device can further comprise one or more liquid containers capable of receiving and holding water therein, and capable of releasing the contained water therefrom. These liquid containers are sized to be containable within the external bag member. These liquid containers may comprise one or more internal bag members, such as, for example, reclosable plastic bags outfitted with a zipper locking system. The handle can further comprise a hollow shaft. The rotating member can further comprise a caster-type swivel mechanism having a stationary end having a mounting stem for attaching to the handle, a rotating end rotatingly attached to the stationary end, rotator bearings to permit smooth rotation of the rotating end, and an axel for receiving said first strap end in attached relationship. Where the handle comprises a hollow shaft, the rotator member mounting stem can be mounted within said hollow shaft and fixed in place using a locking dimple, locking pin or other suitable attachment mechanism.

The exercise device handle can be selected from the group consisting of: mono-axially oriented handles where the user places one hand on top of the other, mono-axially oriented handles where the user places each hand side-by-side, parallel bi-axially oriented handle pairs where the user holds each respective handle pair with each hand's thumb in an upward position, non-parallel bi-axially oriented angled handle pairs where the user holds each respective handle pair with each hand's thumb in an upward position, semi-circular handle pairs, circular handle, and U-shaped handle pairs. Also, the handle can be selected from the group consisting of: handles aligned coaxially with the axis of rotation, handles aligned in parallel with the axis of rotation, handles that are oriented perpendicular to the axis of rotation, handles that are oriented in the same vertical plane beneath the rotating member, handles that deviate from the vertical plane beneath the rotating member, handle sections that are substantially linear, handles that have longitudinal curvature or angularity, handles that are circular or semicircular, handles that are separate rings joined by a housing member containing the rotating member, and ergonomically designed handles.

In another embodiment of the present invention there is described a portable, hand-held exercise device comprising: a hollow core, linear handle capable of being gripped by a user, the handle having a top end and a bottom end, a handle central axis running through the hollow linear core from said bottom end to said top end, and a grip material on at least a portion of the exterior surface of the handle; a swiveling member mechanically attached to the top end of the handle and capable of rotating 360 degrees about the handle central axis; a strap member having a first strap end attached to the rotating member and a second strap end opposite the first strap; an external bag member capable of being attached and detached from the second strap end, and capable of receiving one or more internal bag members; and one or more internal bag members capable of being filled with a desired quantity of water to provide a desired weight resistance prior to use of the exercise device by the user, and capable of being emptied of the water therefrom after use by the user, the one or more internal bag members being sized to be containable within the external bag member. The swiveling mechanism can use one or more rows of ball bearings.

The grip material used to cover all or part of the exterior of the exercise device handle can be selected from the group consisting of: a one-piece rubber sleeve that is placed over the outside of the handle, injection molded grip made from high quality thermo plastic rubber (TPR), other soft elastomeric materials, leather, grip tapes and other suitable gripping materials known in the art.

The exercise device handle of the various embodiments described herein can be is made from metal, plastic, composite, graphite or other suitable material.

The internal bag members used with the present invention may comprise reclosable plastic bags outfitted with a zipper locking system to facilitate easy filling and emptying, and also to permit the one or more bag members to readily burst open upon impact thereby minimizing any injury to person or property owing to such impact.

BRIEF DESCRIPTION OF THE SEVERAL VIEWS OF THE DRAWINGS

FIG. 12A depicts a perspective view of an exercise device handle according to an embodiment of the present invention.

FIG. 12B depicts a top view of the exercise device handle of FIG. 12A.

FIG. 13A depicts a perspective view of an exercise device handle according to an embodiment of the present invention.

FIG. 13B depicts a top view of the exercise device handle of FIG. 13A.

FIG. 14A depicts a perspective view of an exercise device handle according to an embodiment of the present invention.

FIG. 14B depicts a top view of the exercise device handle of FIG. 14A.

FIG. 21A depicts a perspective view of an exercise device handle according to an embodiment of the present invention.

FIG. 21B depicts a top view of the exercise device handle of FIG. 21A.

FIG. 22A depicts a perspective view of an exercise device handle according to an embodiment of the present invention.

FIG. 22B depicts a top view of the exercise device handle of FIG. 22A.

FIG. 23A depicts a perspective view of an exercise device handle according to an embodiment of the present invention.

FIG. 23B depicts a top view of the exercise device handle of FIG. 23A.

FIG. 24 depicts a perspective view of an exercise device handle according to an embodiment of the present invention.

FIG. 25 depicts a perspective view of an exercise device handle according to an embodiment of the present invention.

DETAILED DESCRIPTION OF THE INVENTION

Figure 2:
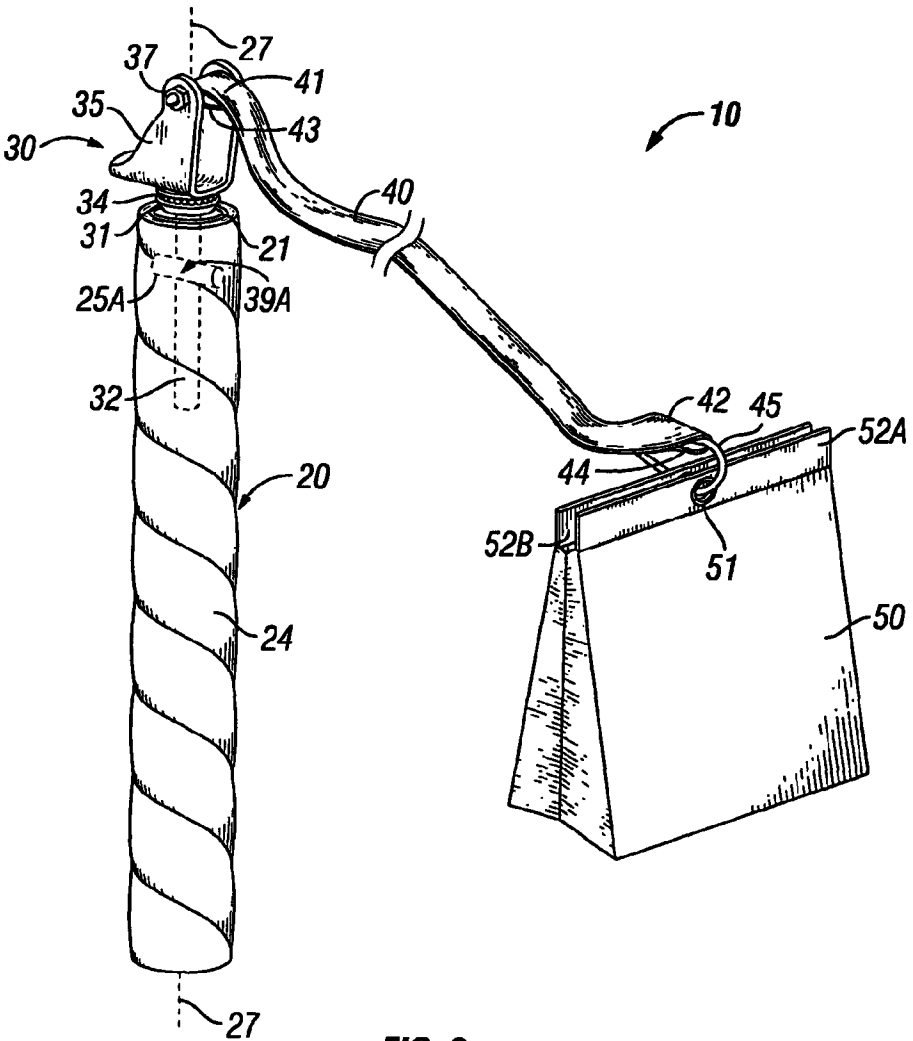
FIG. 2 depicts an exercise device according to an embodiment of the present invention.
Figure 1:
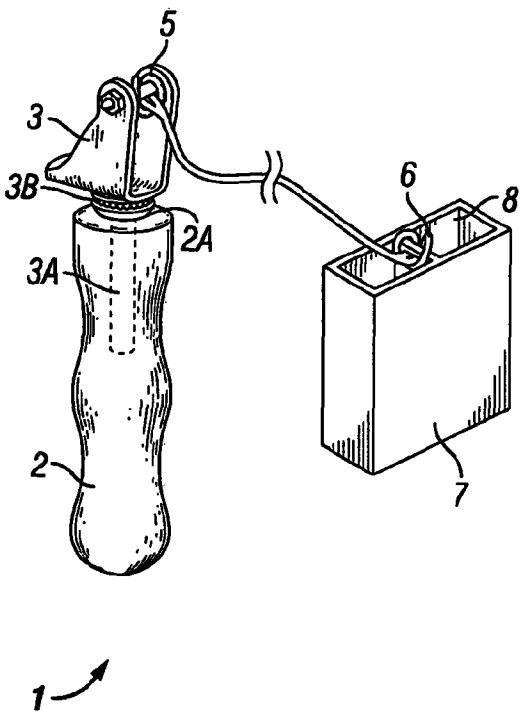
FIG. 1 (Prior Art)
FIG. 1 depicts a prior art exercise device.
Figure 11:
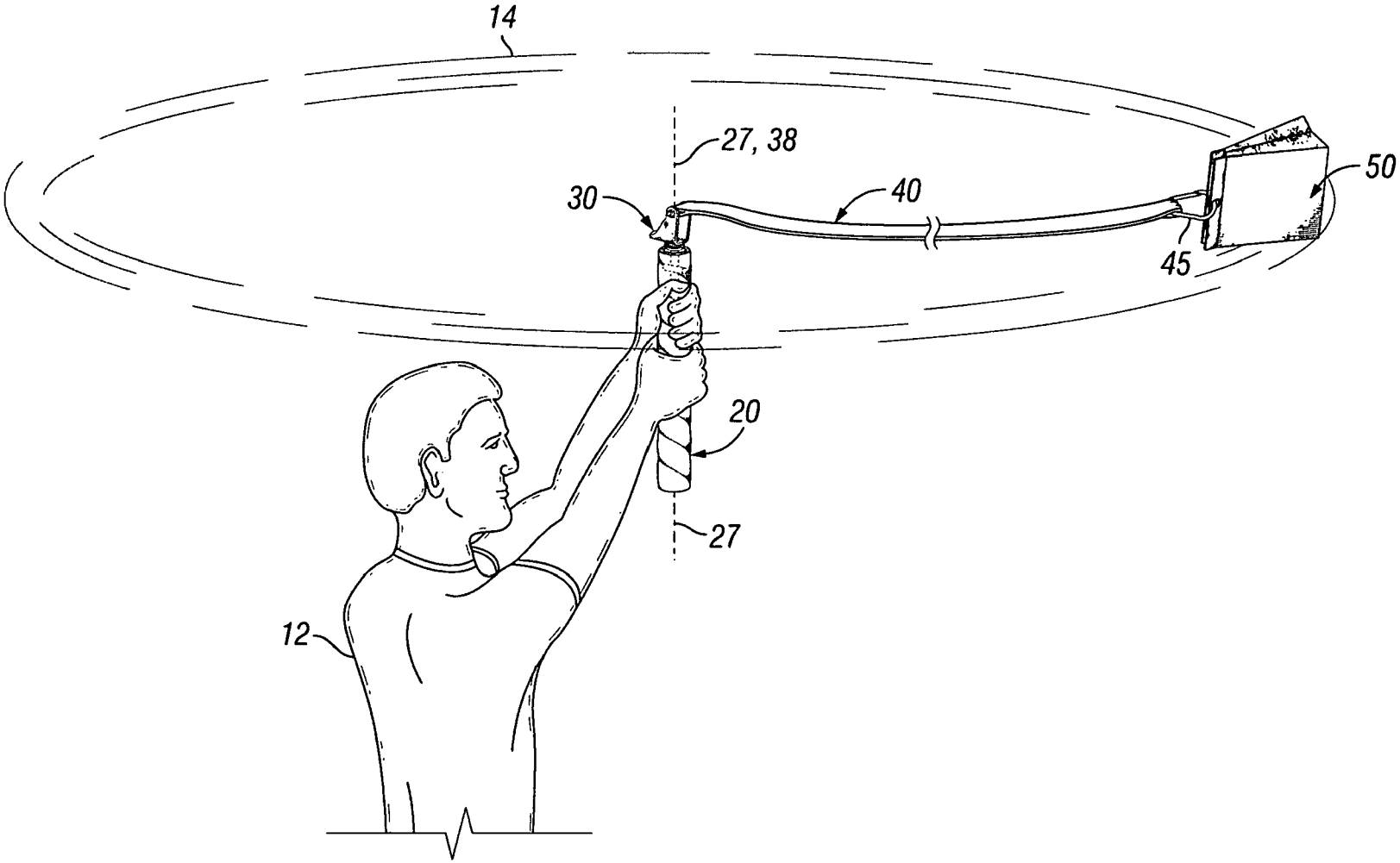
FIG. 11 depicts a user using an exercise device according to an embodiment of the present invention.

Reference is now made to the drawings which depict preferred embodiments of the present invention, but are not drawn to scale. Referring to FIG. 2, there is disclosed an exercise device 10 according to a preferred embodiment of the present invention. In a preferred embodiment of the present invention, the exercise device 10 comprises a handle member 20 having a central axis 27, rotator member 30 capable of rotating about the central axis 27, strap member 40, external bag member 50, and internal bag member 60 (not shown) contained within the interior of external bag member 50 for holding a desired amount of water (not shown). Referring also to FIG. 11, a user 12 places a desired amount of water in the internal bag member 60 within the external bag member 50, grips the handle 20 with one or two hands, holds the handle in a substantially upright position (with hands typically above his/her head) so that the handle 20 and its handle central axis 27 are oriented substantially vertically relative to the ground, and then from a standing, seated or crouching position, the user 12 swings the bag 50 around his/her head and shoulders in an orbital pattern 14. In this mode of operation, the rotator member 30 permits the attached strap 40 and bag 50 to rotate in a substantially radial orbit 14 about the handle axis 27.

In one standard preferred mode of operation, the orbital pattern 14 achieved of the external bag 50 is substantially parallel to the ground. Once the external bag member 50 is set into its orbital pattern 14 (by the user's 12 swinging motion), the user 12 can control the realized weight resistance by increasing the rotations per minute (rpm) to increase the centripetal force (and hence increase the overall weight resistance), or decrease the rpm to decrease the centripetal force (and hence decrease the overall weight resistance). The user 12 can also incrementally add more water or subtract more water from the internal bag member(s) 60, 60A to increase or decrease, respectfully, the pre-loaded weight resistance of the exercise device 10. The weight resistance created will urge the user 12 to use virtually all of his/her muscular system to maintain balance. As such, in addition to providing strengthening to the abdominal/lower back "core" region of the body, the centripetal force also engages leg, foot, arm, wrist, hand, and upper torso muscles to provide a full body work out to users of all age and muscular development levels. Lower amounts of water used in the internal bag member 60, 60A can provide a "high rep", low resistance workout, while higher amounts of water can be used to provide a "lower rep", high resistance workout.

Ideally, in use, the user 12, if using both hands to operate the exercise device 10, will hold the handle 20 with, e.g., the right hand over the left hand while swinging the external bag 50 in one direction, e.g., counterclockwise. The user can then, if desired, complete a set number of rotations, or a set length of rotation time, and then switch the direction of the swing, e.g., clockwise. Likewise, the user can reverse the hand hold so that the handle 20 is held with the left hand over the right hand while repeating the desired clockwise, counterclockwise swinging sequences. Additionally, the user 12 can also, if desired, alter the orbital pattern 14 to deviate from one that is substantially parallel to the ground. Although two-handed operation is a preferred mode of operation, the exercise device 10 of the present invention can also be beneficially used with a single hand. Additionally, as discussed later, other handle configurations can be employed.

The exercise device 10 of the present invention is a sturdy, well-built tool with a specially balanced handle/rotator section which makes it very easy to use by all ages and physical abilities. Users swing the weighted bag around their head and shoulders—using easily available water to vary the weight. Centripetal force is generated by the orbiting weighted bag and causes the user to firmly flex and exercise virtually every muscle to keep the user from being pulled over by the resulting weight. The result is an exercise routine that works virtually every muscle within the user's body at the same time.

When a user vigorously swings the bag around, centripetal force compounds the resistance. Such compounding is thought to be up to 9 times. A pint of water in the bag becomes 9+ pounds—a quart of water becomes 18+ pounds, a half gallon of water becomes more than 35 pounds and a full gallon of water becomes over 70 pounds. The user 12 selects his or her starting resistance weight and increases it as he or she gains muscle, strength and improved conditioning. By exercising with this device 10 for only 20 minutes per day, this device 10 will make the user stronger, trimmer, more flexible, and better balanced with a much improved grip. More weight resistance makes the workout more vigorous and provides faster and better results for users. This exercise tool 10 provides useful exercise to any body type.

This device 10 provides users the benefits of cardiovascular training, weight training, isometrics—force against an immovable object, and aerobics-walking, jogging, swimming, etc. without strain on the back, strain on joints, strain on knees, the need for fancy equipment, or the need to go to the gym to workout. Use of the device 10 provides benefits with just a brief, daily 10-20 minute workout. Additionally, apart from using the device 10 for the primary workout tool, the user can employ the device 10 for use in conducting warm-ups prior to physical exercise or work.

A user's overall body strength will become more balanced. Exercise will strengthen the user's less dominant side and less dominant muscles creating desired balance of strength and conditioning in left and right side arms, hands, shoulders and back making each side of the body stronger.

Greater grip and hand strength will become noticeable. This permits holding and controlling all hand utensils with less effort. With stronger hands, less tension is needed in the arms to support a better grip. This results in free arm movement when it is needed.

An athlete's use of this device 10 can serve as an important complement to his or her strengthening and conditioning. For non-athletes, the benefits of use of this device 10 transcend into an improvement to the user's daily physical activities and overall cardio-vascular health. Additionally, the use of this device 10 can also serve as an effective, fast means for warming-up the body prior to other activities, whether athletic (i.e., pre-game, workouts, etc.) or otherwise strenuous (i.e., shoveling snow, yard work, etc.).

Upper body strength and improved wrist, forearm and biceps strength will occur with use of this device 10 making it easier to sweep, rake, shovel snow, carry items, mop/sweep the floor or get on and off busses or other transportation. Older users of the device 10 will find it easier to enter or exit automobiles and wheelchair bound users will find it easier to handle and control their chair. Handicapped persons will find it easier to move in and out of public restroom facilities.

Improved balance through use of the device 10 will become evident making it easier to climb stairs and walk distances for exercise. Getting around easier will improve self-confidence.

Improved strength and conditioning in back and shoulders will improve overall posture in users of the device 10. The improved flexibility achieved through use of the device 10 will increase enjoyment of life. The improved stamina achieved through use of the device 10 will increase enjoyment of all activities and allow users to be active more often. Better overall conditioning will reduce the possibility of pulled muscles and other injuries.

This exercise tool 10 will improve user's physical abilities at golf, tennis, bowling, softball, baseball, basketball and any other sporting activity and every other action from house and yard work to shoveling snow to dancing.

Referring now to FIGS. 2, 3A-B, 4A-F, 5A, and 11, in a preferred embodiment, the handle member 20 comprises a shaft 21 having a shaft bottom end 22 and a shaft top end 23 opposite the shaft bottom end 22. The shaft 21 is preferably of a length sufficient to at least accommodate a two-handed grip. In a preferred embodiment, the shaft 21 is about 10-11 inches in length, but other lengths could be employed. For example, a standard golf club shaft (with grip) could serve as the handle member 20 and shaft 21 where the rotator member 30 is mounted to the end of the club shaft where the club head would normally be located. Similarly, a tennis racquet (or other racquet sport) handle could be adapted to serve as the handle 20. Likewise, a baseball bat could be outfitted with a rotator member 30 on its end opposite the grip end so that the bat itself (with its grip material) would serve as the handle member 20 and shaft 21.

In a preferred embodiment, the shaft 21 is about ½-⅝ inch in diameter, but other diameters can be employed. In one preferred embodiment, the shaft 21 is of a solid core (21A) or hollow core (21B) construction. In a preferred embodiment, the shaft 21 is constructed from a hollow metal tubing, such as that used for a golf club shaft. In another preferred embodiment, the shaft 21 is constructed from a hollow metal pipe. In an alternate embodiment, the shaft 21 is constructed of a solid metal material. In another alternate embodiment, the shaft 21 is constructed of a hollow plastic material such as cpvc pipe tubing or other plastic. Many other suitable shaft materials exist in the art, including metals, alloys such as titanium, zinc and aluminum alloys, HST aluminum, 431 stainless steel, 17-4 stainless steel, Ti-alloy, maraging metal, bi-metal, tungsten insert, plastics, injection molded plastics, ceramics, graphite, boron, Kevlar® and other synthetic materials, carbon fiber, resin, fiberglass, composites, wood, laminated wood, compositions thereof and the like, including those materials employed in golf club shafts, tennis racquet handles, baseball bats, and hockey sticks. In another preferred embodiment of the present invention, the shaft 21 is fitted with weighted inserts (not shown). In a preferred embodiment, the shaft 21 is constructed from steel or graphite. Although in a preferred embodiment the shaft 21 is about 10-11 inches in length and is substantially covered with a grip material 24, it is possible that the shaft 21 will only be partially covered by a grip material (i.e., where a longer shaft is employed), in which case, the shaft may be finished in any desired finish, such as plain metal, brushed metal, painted metal, chrome metal (where the shaft is metal) to any other desired finish (e.g., where plastic or other synthetic material is employed, a desired finish could be integrated into the plastic or synthetic material, or a finish such as paint could be applied).

In a preferred embodiment, the outside shape of the shaft 21 is substantially cylindrical in shape, much like the grip end of a golf club shaft, but frusto-conical, tapered shapes (not shown) are also possible. In another preferred embodiment, the shaft 21 is rectangular in shape (not shown), much like a tennis racquet handle. In yet another embodiment, the shaft 21 is in the shape of the grip area of a baseball bat (not shown). As will be discussed further below, the outside of the shaft 21 can also include a grip material 24 of unitary or varied thickness depending on the desired grip contour desired by the end user.

Referring still to FIGS. 2, 3A-B, 4A-F, 5A-C and 11, there is depicted a rotator member 30 attached to the shaft 21 top end 23. In a preferred embodiment, the rotator member 30 comprises a caster-type mechanism (without the wheel). The rotator member 30 can be finished with any finish desired, from plain metal, chrome-covered metal, to painted metal.

Although not as preferred, it is possible that the rotator member 30 could be made of other structural non-metal materials such as plastics, ceramics, and the like. In this embodiment, the rotator member 30 comprises a stationary end 31, a mounting stem 32 attached to the stationary end 31, and a rotating end 35 rotatably attached to the stationary end 31 and aided by the presence of one or more rows of ball bearings or swivel bearings 34. In this caster-like embodiment, the rotating end 35 has two opposed wings 35A and 35B. A removable rotator member axel 36 is removably attached between opposed wings 35A and 35B. In a preferred embodiment, the axel 36 comprises a length of all-thread 36A, and is attached to the wings 35A, 35B with nuts 37. Preferably, the nuts 37 are acorn lock nuts, other lock nuts, or other suitable securing fasteners. If desired, the threads of the all thread disposed between the wings can be covered with a tube or sleeve 36B. Any number of alternative axel members 36 can be employed, such as a bolt 36, a rod with cotter pin fasteners, etc.

Figure 3A:
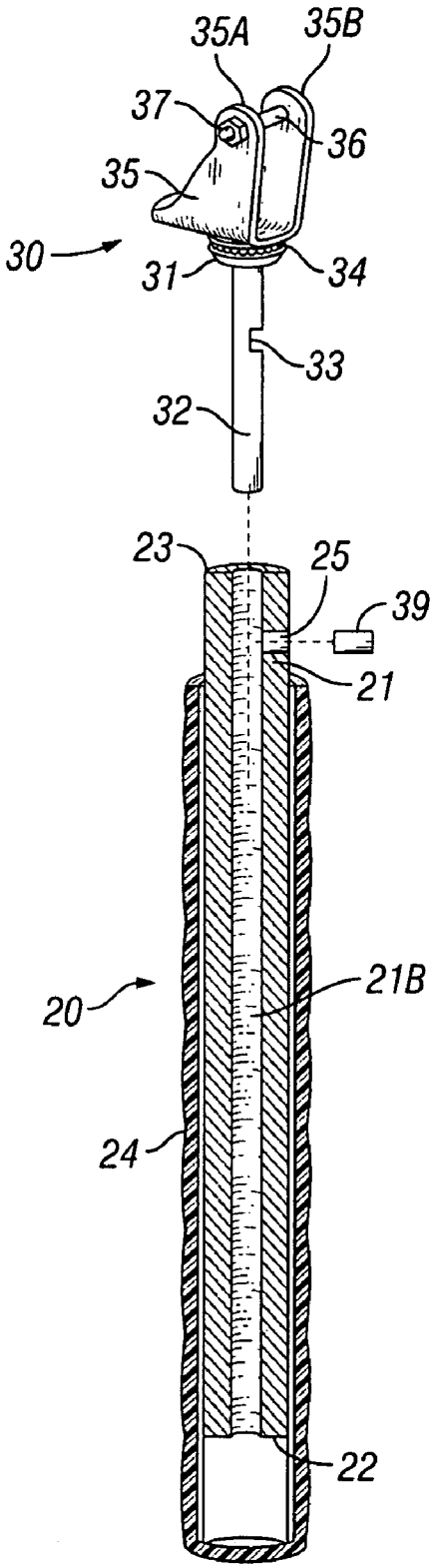
FIG. 3A depicts an exploded, partial cross-sectional view of an exercise device handle and rotator according to an embodiment of the present invention.
Figure 3B:
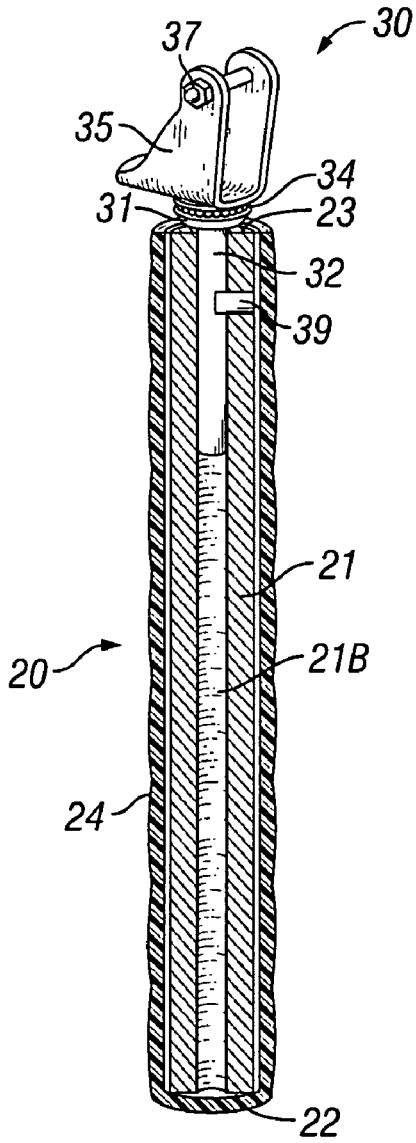
FIG. 3B depicts a partial cross-sectional view of an exercise device handle and rotator according to an embodiment of the present invention.

The stationary portion 31 of rotator member 30 can be attached to the end 23 of shaft 21 in any manner of acceptable modes of attachment known in the art. For example, in a preferred embodiment, mounting stem 32 (which could be a standard caster stem or the like) has a diameter or cross-sectional width of "X" and can slip into a mated receiving orifice 26 in the end 23 of shaft 21 where such orifice 26 is of a diameter or cross-sectional width of "X" (or close tolerance thereto) so that the stem can fit therein in snug relationship. For example, a ½ inch inner diameter tubing used for the shaft will provide an appropriately sized orifice 26 to receive a standard caster stem diameter; however, other dimensions are possible. The stem 32 can then be glued, welded or otherwise fixably attached to the shaft in conventional manner. Referring to FIGS. 3A-B, in one preferred embodiment, the shaft 21 is hollow and is fitted with a shaft locking groove or slot 25 and the rotator stem 32 is likewise fitted with a stem locking slot or groove 33 such that when the stem 32 is slipped into or coaxially mated with the shaft orifice 26, the shaft locking slot 25 can be aligned with the stem locking slot 33 and a locking pin or roll pin device 39 can be employed in the aligned slots 25, 33 to lock the stem 32 to the shaft 21. In a preferred embodiment, the roll pin 39, once installed in these slots, remains substantially flush with the outer diameter of the shaft 21. In the alternative to using a locking pin to secure the two grooves 25, 33, weldment or soldering could be employed. Similarly, referring to FIGS. 4A-B, in an alternate preferred embodiment, a pin hole or shaft locking channel 25A is drilled perpendicularly through the shaft upper end 23 and stem 32 so that a pin 39A can be replaced in the hole formed to lock the stem 32 to the shaft 21. If the stem 32 is of sufficient diameter to accommodate the diameter of the shaft locking channel 25A then the channel 25A can be drilled radially through the stem 32 and shaft 21 so that once the stem 32 is inserted into the shaft 21, a locking pin 39A (preferably of a length substantially equal to the length of the channel 25A) can be used to lock the stem 32 to the shaft 21. Alternatively, the stem locking channel 25A could be drilled through shaft 21 in an offset fashion so that a sufficient portion of the pin 39A will engage the stem locking groove 33.

Figures 4A, 4D, 4E, 4F:
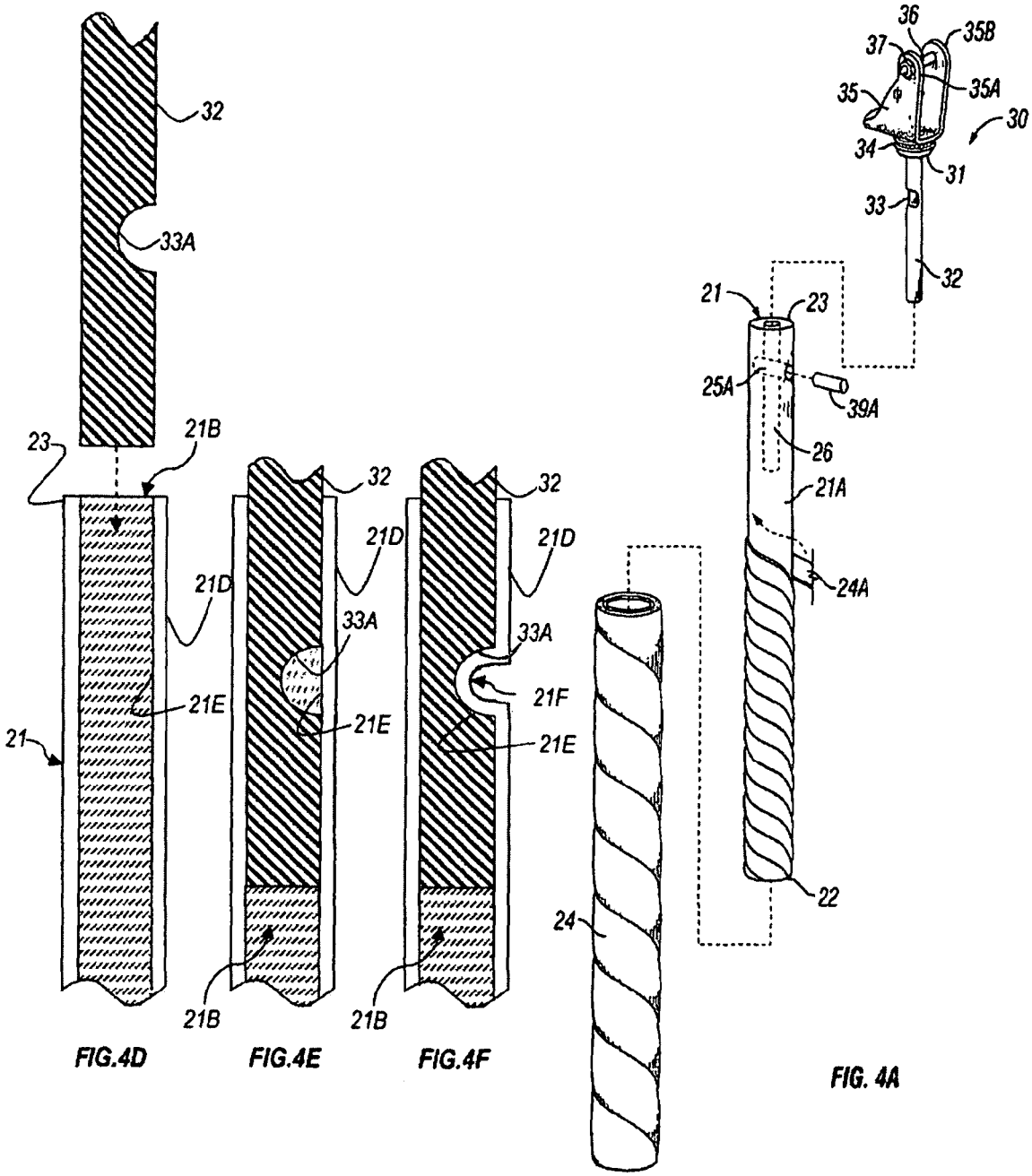
FIG. 4A depicts an exploded view of an exercise device handle grip, handle shaft and rotator according to an embodiment of the present invention.
FIG. 4D depicts a partial cross-sectional view of an exercise device handle and rotator shaft according to an embodiment of the present invention.
FIG. 4E depicts a partial cross-sectional view of an exercise device handle and rotator shaft inserted therein according to an embodiment of the present invention.
FIG. 4F depicts a partial cross-sectional view of an exercise device handle and rotator shaft in installed, locked position according to an embodiment of the present invention.
Figure 4B:
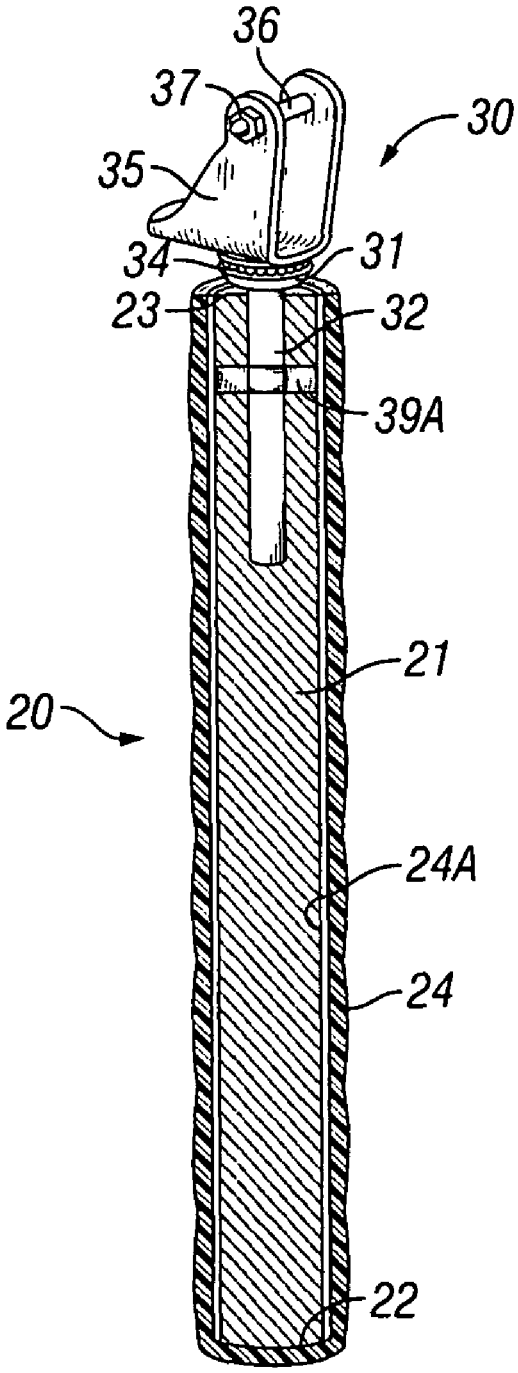
FIG. 4B depicts a partial cross-sectional view of an exercise device handle and rotator according to an embodiment of the present invention.

Also, referring now to the preferred embodiment shown in FIGS. 4D-F, the shaft 21 is depicted as being hollow, having a shaft outer wall 21D and a shaft inner wall 21E. In this embodiment, the shaft inner diameter is sized to create a shaft central hollow core 21B that snugly receives the outer diameter of the rotator member mounting stem 32. For example, where the diameter of the stem 32 is ½ inch, then the inner diameter of the shaft 21 will be ½ inch, and the shaft wall thickness (i.e., the distance between shaft inner wall 21E and shaft outer wall 21D) could be 1/16 inch or other suitable thickness. Shown also in the embodiment of FIGS. 4D-F is a preferred mechanism for mounting the stem 32 within the shaft 21. In this embodiment, the stem 32 is modified to include a locking dimple 33A (not shown to scale), which can be created in a number of ways, including by drilling the shaft perpendicularly at one edge with a suitably-sized drill bit (e.g., ¼ inch to ⅜ inch where the shaft is ½ inch diameter). The resulting dimple 33A is preferably of a concave shape, but other dimple shapes and sizes could be suitably employed. FIG. 4D shows the stem 32 (with dimple 33A) of the rotator member 30 prior to the mounting step. The stem 32 is then inserted into the shaft 21 as shown in FIG. 4E. A focused, compression force is then applied to the outside wall of the shaft 21 centered/aligned with the stem dimple 33A so that the shaft wall is compressed into the stem dimple 33A to create a shaft outer wall locking dimple 21F (shown in FIG. 4F). The step of creating such shaft outer wall dimple 21F can be accomplished in many suitable ways, including, creating a jig to align a punch or other suitable member with the stem dimple 33A, and then to apply a force on the punch, transverse (perpendicular) to the shaft outer wall, and then permitting such force to compress the outer wall of the shaft 21 into the stem locking dimple 33A. As such, once the shaft outer wall locking dimple 21F (not shown to scale) is formed, the stem 32 is now locked into place within the shaft 21. The shaft wall material is preferably metal, and capable of being deformed to create the shaft locking dimple 21F but other suitable materials known in the art capable of being deformed to create such a locking dimple could be employed for the shaft material, such as those noted herein. If desired, the shaft (now containing the stem in locked relationship) can then be wrapped with a desired grip material 24. Although this locking embodiment is shown being created in a hollow shaft 21, the shaft could be solid, and the stem (with locking dimple 33A) could be inserted into the shaft mated receiving orifice 26 (such as depicted in, e.g., FIG. 4A) and the shaft outer wall locking dimple could then be formed.

The stem 32 of a caster-type rotator member 30 can also be of the grip neck and grip ring stem variety used with chair casters, and can be mounted to the grip shaft 21 via use of a socket, such as those sockets inserted into the bottom of a chair leg, wherein the socket is mounted into the upper end 32 of the shaft 21, and the caster stem 32 is in turn mounted into the socket thereby securing the caster to the shaft 21. Various caster designs, such as stem mounted swivel casters, grip necks and grip rods can be found at most hardware or furniture stores, and are also available on the world wide web at, e.g., CasterCity.com. The frame of a caster is often called a caster bracket, rig or fork. All of these words are used to refer to the frame which houses or holds the wheel (but in this invention, no wheel is employed. A caster frame employed in the present invention is a swivel frame which is capable of capable of rotating 360°. In most instances, a swivel caster has two "legs" (35A, 35B). One leg is on each side of the location where a wheel is normally installed in the caster frame. The wheel (not used) is traditionally held in place between the legs of the caster frame by a bolt or axle 36. Above the legs on a swivel caster is the swivel bearing 34, which allows a swivel caster to rotate or turn 360°. The top or stationary end 31 of a caster 30 is used to attach the caster to the equipment, here shaft 21. There are many ways to attach a caster to a piece of equipment. In addition to mounting a caster stem into the shaft, another means of attachment is a mounting plate, often called the top plate. The mounting plate on a swivel caster is connected to the swivel bearing and to the legs below the swivel bearing. Most mounting plates on casters contain four holes used to bolt the caster on. Sometimes casters are attached by welding the mounting plate of the caster to the equipment. With respect to the linear shaft embodiment of e.g., FIG. 5A, mounting a caster stem within the shaft would be preferred. With respect to other handle embodiments discussed herein, e.g., FIGS. 12A, 14A, 15A, 16A, 17A, 20A, 22A, 23A, using a plate mounted caster for mounting to plates 121, 161, 201, 261 would be preferred. Proper maintenance requires all bearings be relubricated on a regular schedule, and all bolts and nuts be kept tightened.

Some of the other popular ways to attach a caster to equipment include the following: an expandable rubber stem to insert into tubing; a round or square solid metal stem, also inserted into tubing; an octagonal shaped stem with cross drilled holes to be bolted to angle iron legs; a threaded stem to either go into a tapped hole or to pass through a hole and held in place with a lock nut. There are many other means to attach or fasten a caster onto equipment.

In a preferred embodiment, the rotator member 30 comprises an office chair caster with the wheel removed (i.e., the caster frame, caster rig, caster fork). An exemplary caster is the type in the Series 69 and 70 office chair casters offered by Bassick and other casters offered by Shepherd. Information about many caster types is available on the worldwide web at the websites of, e.g., castercity.com and casterconnection-.com In yet another preferred embodiment, the rotator member can be another type of rotational member (other than a caster) that permits axial rotation of a member while such member is attached to one of the exemplary handles described herein. In yet another embodiment, the rotator member is secured to the upper end 23 of shaft 21 by fitting a female member of the rotator stationary member 31 over the outer diameter of end 23 of shaft 21.

Figure 4C:
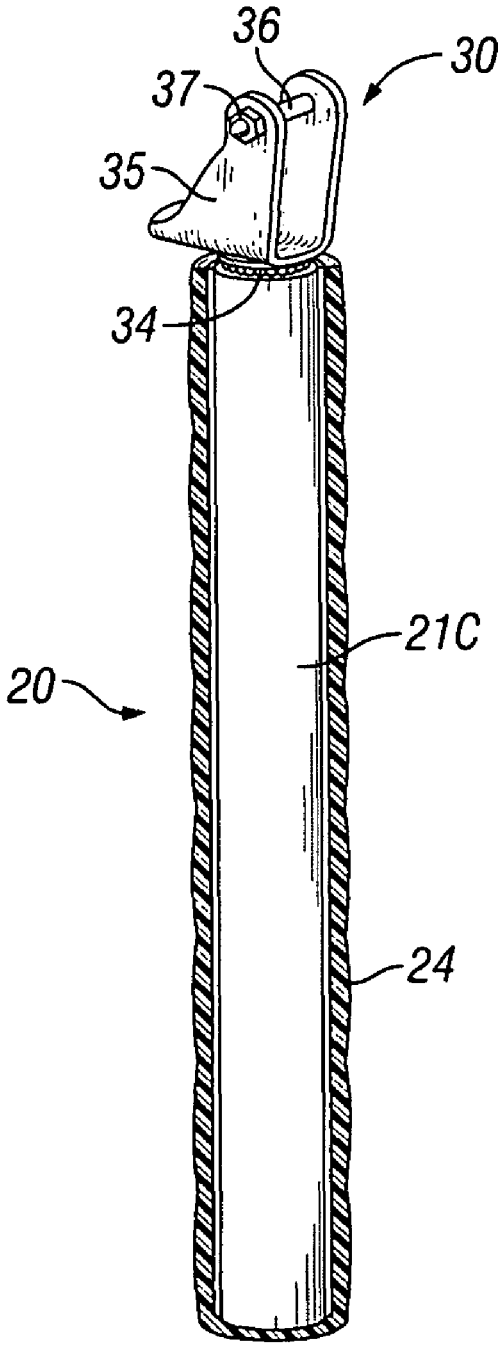
FIG. 4C depicts a partial cross-sectional view of an exercise device handle and rotator according to an embodiment of the present invention.

Referring to FIG. 4C, in an alternative preferred embodiment, the rotator stationary end stem 32 is sized sufficiently to also serve as the shaft 21C and could be solid or hollow core. In yet another preferred embodiment, the rotator member stationary end 31 and shaft 21 are of a unitary construction.

Figure 5B:
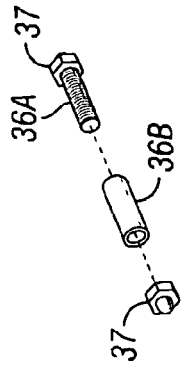
FIG. 5B depicts a rotator axel device according to an embodiment of the present invention.
Figure 5C:
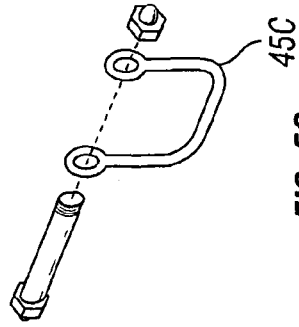
FIG. 5C depicts a connector device according to an embodiment of the present invention.
Figure 5A:
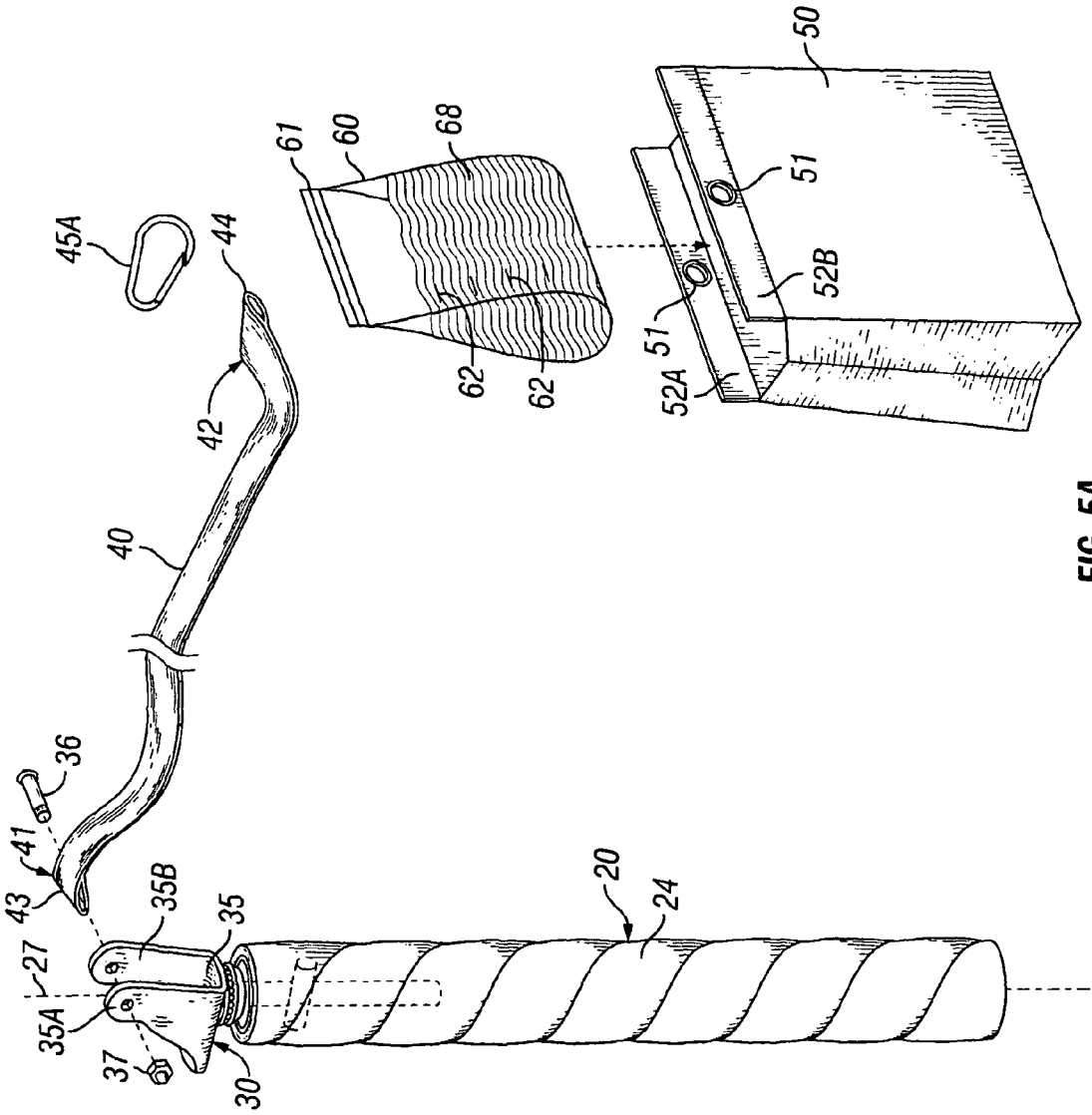
FIG. 5A depicts an exercise device according to an embodiment of the present invention.

The outside diameter of shaft 21 can be varied depending on the grip size desired by the end user. Preferably, the outside of the shaft 21 is covered with a grip material 24. In a preferred embodiment of the present invention, the stem 21 (or other hand grip elements later described) is covered by a hand grip material such as, for example, a one-piece rubber sleeve that is placed over the outside of the handle, and if necessary, is secured thereon with an adhesive material. An exemplary grip material is an injection molded grip made from high quality thermo plastic rubber (TPR), such as are certain of the TACKI-MAC® brand of grips offered on the web at tacki-mac.com. The use of TPR, which is a preferred grip material, provides the grips with an exceptional tacky feel for comfort, control and grip performance whether hot or cold, wet or dry. The use of TPR or other soft elastomeric materials also provides a long lasting grip that will provide a consistent tacky feel, resist chipping, and not crack or dry out. The exterior surface of a grip made with TPR can feature any number of texture designs, and grip patterns including, wrapped, serrated, square dot, smooth, waffle, and knurled designs. Other grip styles, including leather, and grip tapes are possible. Additionally, much like with a tennis racquet handle/grip design, the handle 20 of the present invention depicted in, e.g., FIGS. 5A and 11, is designed to be of an ambidextrous design since it is envisioned that the end user will alternate use between a left hand over right hand grip and a right hand over left hand grip.

There exist many grip designs, including those with ergonomic features, that can be employed to benefit in the present invention. For example, Babolat's tennis racquet SMART GRIP™ handgrip design (babolat.com) is contoured to fit the shape of the user's hand or hands. The special shape of this ergonomically designed grip places the entire hand in contact with the handle resulting in more power with less effort, more control with less handle twisting and more comfort due to the way the grip fits the natural shape of the hand. In similar fashion, the grip contour of the handle 20 (or other hand grip elements of the other handles described below in connection with FIGS. 12A-25) of the present invention can likewise be customized, for example, to employ the SMART GRIP™ technology or other grip technologies. The versatility of the present invention provides an end user with the ability to customize the design of the handle 20 to accommodate his or her personal preferences. For example, an athlete of any age (whether professional, amateur, collegiate, or recreational) who focuses on racquet or stick sports may prefer to have a handle design similar to or identical with his or her favorite racquet/stick handle; tennis, badminton, squash or racquetball players might prefer a handle shape similar to the one used in their racquet sport; baseball players might prefer a handle more in the shape of the grip area of their baseball bat; a hockey or polo player might prefer a handle more in the shape of the grip area of a hockey or polo stick; a golfer might prefer a handle similar to a golf handle, etc.

Even for the multitudes of others, of all ages and abilities, and whether fully or partially mobile, desiring the benefits of the full body exercise achieved with use of the present invention, the handle design can be varied to accommodate the hand size, grip size and grip comfort desired or required by such end users. Additionally, the outer grip 24 design can be changed or modified at any time by the end user using conventional grip technologies, such as grip tape, overgrips, and any number of desired grips can be employed, such as, for example, the variety of grips available in the art for golf clubs (where the shaft 21 is designed like a golf club), for tennis racquets (where the shaft 21 is designed like a tennis racquet handle), etc.

In one preferred embodiment of the present invention, the shaft 21 is much like the shaft of a golf club and has an outer grip 24 attached. Although there are many ways to attach grip material to a shaft (or to replace old grip material with new grip material), one common method employs the following basic steps. Any adhesive residue from the shaft 21 is removed using a fine steel wool and mineral spirits. Obtain a double sided tape or grip tape 24A, such as that sold through golf pro shops or other grip supply companies. This double sided tape with rubber based adhesive typically has a crinkled release liner for easy application. Carefully spiral-wrap double-faced tape 24A around the shaft 21, from the top of the shaft to within about ⅛ inch of the end of the new grip. Make sure the edges of the spiral wound tape are slightly separated—not overlapped. If you want to build up the grip, add one or two more layers of tape to the first layer until the desired grip size is achieved. Alternatively, take a rectangular piece of double sided tape (not shown) that has a desired length of coverage area, and a width equal to about the outer diameter of the shaft 21 so that this rectangular piece of double stick tape can be applied to cover the desired area of the shaft without the need to spiral wrap a thinner width tape. Lock the shaft in a vise, padding the jaws of the vise so the jaws don't damage the metal. Remove the outer protective paper coating from the tape. Then coat the outer surface of the tape 24A with mineral spirits to make it slick. As an alternative to mineral spirits, a product containing nonflammable, non-toxic, non-ozone depleting, low VOC blends of surfactants, emollients, isoparaffins, and water is also available as a grip solvent from most grip suppliers or pro shops. It is odorless and colorless, and allows for very effective grip installation at a use ratio of 50% of current volume. Slide the new grip over the tape, being careful not to rip the tape or the grip. If the grip becomes stuck on the tape prior to gaining its final position, re-slick the tape with more mineral spirits/solvent. Grasp the grip by the open end and pull it down over the shaft. Work the grip around the shaft so that it is centered on top of the shaft. Finally, after installing the grip, squeeze the grip with your hand several times so the tape adheres to the inside surface of the grip. Allow the grip to dry prior to use.

Although the preferred embodiment of the present invention employs a single, mono-axially oriented handle, such as that shown as element 20 of FIGS. 2, 3A-B, 4A-C, 5A and 11, the present invention could also employ any number of alternate handle configurations such as those depicted in FIGS. 12A-25 (shown without axel 36, strap 40 or attached bag 50) that could be attached to a suitable rotator member 30 having an axis of rotation about axis 38. These alternate handle configurations (120, 130, 140, 150, 160, 170, 180, 190, 200, 210, 220, 230, 240 and 250) could also incorporate ergonomic design considerations to optimize, e.g., grip alignment and wrist alignment from a comfort and/or biomechanics standpoint. For example, referring now to FIGS. 12A-12B, there is depicted a perspective view (FIG. 12A) and a top view (FIG. 12B) of a handle member 120 having a top bracket 121 (shown in a substantially "L" shape) for centrally attaching on its top face a rotator 30, and on the underside of each of the ends 121A, 121B of the "L" bracket, a left handgrip 122 (having left handgrip axis 122A) and right handgrip 123 (having right handgrip axis 123A). Although the bracket 121 is shown in a substantially "L" shape where bracket angle 124 is about 90 degrees, the angle 124 could be varied from a minimal angle permitting sufficient distance 128 between grips 122, 123 to permit gripping by the user, up to 180 degrees (such as in the embodiment depicted in FIGS. 16A-16B). The user could hold right handle in right hand, and left handle in left hand, or could hold right handle in left hand and left handle in right hand. Additionally, in the embodiments shown in FIGS. 12A, 13A, 16A and 17A the left handgrip 122 and right handgrip 123 are preferably mounted such that their respective axes (122A, 123A) are substantially parallel to rotator axis 38 so that their respective left handle angle 125A and right handle angle 125B are approximately 90 degrees with respect to respective handle bracket sides 121A and 121B.

Referring to FIGS. 13A-13B the embodiment of FIGS. 12A-12B is modified structurally to add to handle 130 a lower bracket 126 of substantially similar size and shape as top bracket 121. Additionally, for added support a structural column 127 is attached between the top and lower brackets along the axis of rotator rotation 38. In an alternative embodiment to FIGS. 12A and 13A, the upper and lower (FIG. 13A) "L" shaped brackets 121, 126 are of a two part construction such that that, for example top bracket 121 is formed from two pieces 121A and 121B that are connected along axis 38, and in the case of FIG. 13A, lower bracket 126 is formed from two pieces 126A and 126B that are axially connected along axis 38, wherein such axial connection can be adjusted to vary bracket angle 124 and then lock the positioning of the handles 122, 123 into place with a locking mechanism such as a nut/bolt or other suitable mechanism (not shown).

Figure 17A:
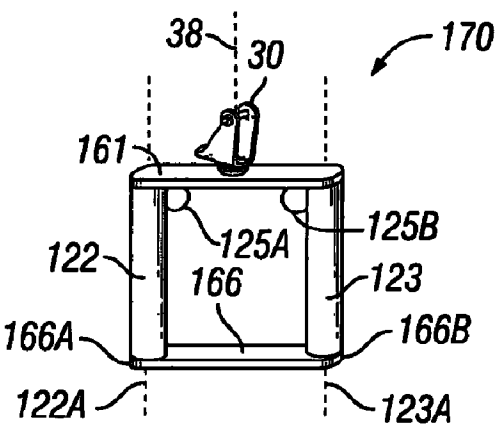
FIG. 17A depicts a perspective view of an exercise device handle according to an embodiment of the present invention.
Figure 17B:
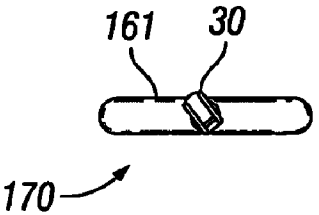
FIG. 17B depicts a top view of the exercise device handle of FIG. 17A.
Figure 16A:
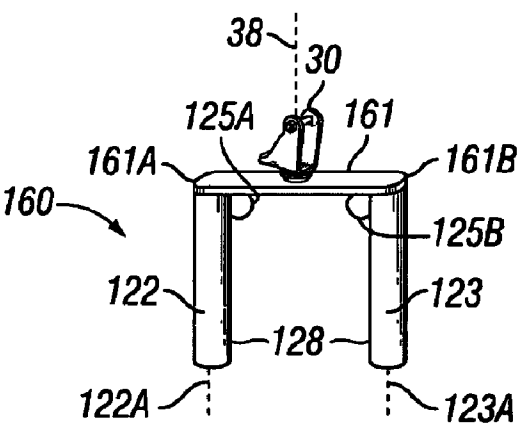
FIG. 16A depicts a perspective view of an exercise device handle according to an embodiment of the present invention.
Figure 16B:
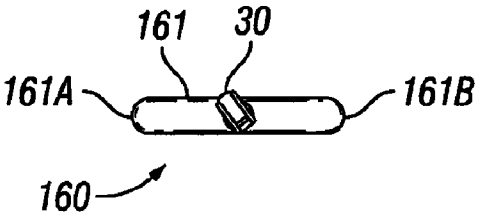
FIG. 16B depicts a top view of the exercise device handle of FIG. 16A.

FIGS. 16A-16B show a perspective and top view of another handle embodiment 160 having an upper bracket 161 having left and right ends 161A, 161B. FIGS. 17A-17B show a perspective and top view of another handle embodiment 170 similar to that in FIGS. 16A-16B, but also having a lower bracket 166 having left and right ends 166A, 166B. The embodiment shown in FIGS. 16A-16B is similar to that of FIGS. 12A-12B when bracket angle 124 is 180 degrees. The embodiment shown in FIGS. 17A-17B is similar to that of FIGS. 13A-13B when bracket angle 124 is 180 degrees.

Referring now to FIGS. 14A-14B, there is depicted a perspective view (FIG. 14A) and a top view (FIG. 14B) of a handle member 140 having a top bracket 161 for centrally attaching on its top face the rotator 30, and on the underside of each of the ends 121A, 121B of the bracket 161, a left handgrip 122 (having left handgrip axis 122A) and right handgrip 123 (having right handgrip axis 123A). The embodiment shown in FIGS. 14A-14B is similar to that of FIGS. 16A-16B except that left handgrip angle 125A and right handgrip angle 125B are less than 90 degrees; thus, handgrip axes 122A and 123A are not parallel with rotator axis 38. In this embodiment, left handgrip 122 and right handgrip 123 are also generally located inside of the vertical plane formed beneath the bracket 161.

Figure 15A:
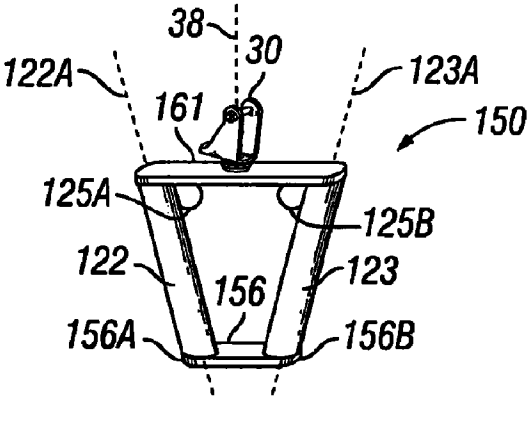
FIG. 15A depicts a perspective view of an exercise device handle according to an embodiment of the present invention.
Figure 15B:
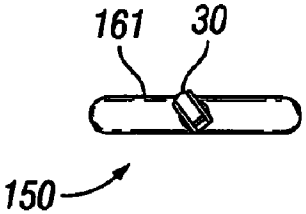
FIG. 15B depicts a top view of the exercise device handle of FIG. 15A.

FIGS. 15A-15B show a perspective and top view of another handle embodiment 150 similar to that in FIGS. 14A-14B, but also having a lower bracket 156 having left and right ends 156A, 156B. The embodiment shown in FIGS. 15A-15B is similar to that of FIGS. 17A-17B except that left handgrip angle 125A and right handgrip angle 125B are less than 90 degrees; thus, handgrip axes 122A and 123A are not parallel with rotator axis 38. In an alternative embodiment (not shown) of the handle 140, 150, respectively, depicted in FIGS. 14A-B, 15A-B, the handgrip angles 122A and 123A could be greater than 90 degrees up to a maximum 180 degrees (for the embodiment of FIG. 14A) so long as there remains clearance between the rotator axel 36 (where the strap 40 connects) and the user's hands so that the strap 40 can rotate in its orbital pattern 14 without obstruction from the handle or the user's hands on the handles.

Referring also to FIGS. 23A-23B, there is depicted a perspective view (FIG. 23A) and a top view (FIG. 23B) of a handle member 230 having a top bracket 161 for centrally attaching on its top face the rotator 30, and on the underside of each of the ends 121A, 121B of the bracket 161, a left handgrip 122 (having left handgrip axis 122A) and right handgrip 123 (having right handgrip axis 123A). The embodiment shown in FIGS. 23A-23B is similar to that of FIGS. 14A-14B except that left handgrip 122 and right handgrip 123 are also angled outside of the vertical plane formed beneath the bracket 161. In similar fashion, the handgrips 122, 123 in FIGS. 16A-B could likewise be angled outside of the vertical plane existing beneath bracket 161.

Figure 18A:
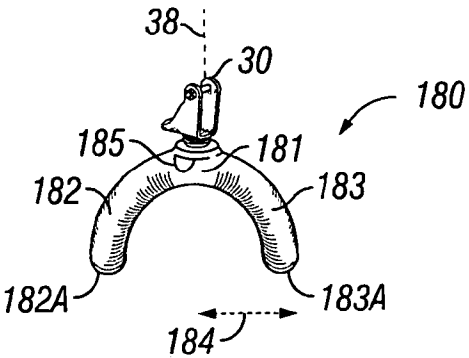
FIG. 18A depicts a perspective view of an exercise device handle according to an embodiment of the present invention.
Figure 18B:
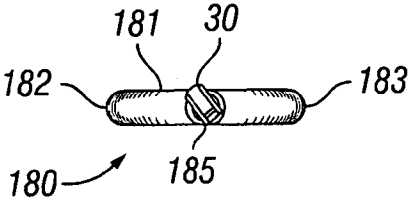
FIG. 18B depicts a top view of the exercise device handle of FIG. 18A.

Referring now to FIGS. 18A-18B, there is depicted a perspective view (FIG. 18A) and a top view (FIG. 18B) of a handle member 180 having a substantially semicircular tubular member 181 comprising a left side section forming a left side semicircular grip 182 and a right side section forming a right side semicircular grip 183 and an outer semi-circumference located at a desired radial distance 184. In this embodiment, the rotator 30 is mounted or otherwise attached at the midpoint 185 between points 183*a* and 182*a* along the outer radius 184 such that the rotator axis of rotation 38 is aligned substantially radially through such midpoint 185.

Referring also to FIGS. 21A-21B, there is depicted a perspective view (FIG. 21A) and a top view (FIG. 21B) of a handle member 210 having a substantially circular tubular member 211 comprising a left side section forming a left side semicircular grip 212 and a right side section forming a right side semicircular grip 213 and an outer radial distance 214. In this embodiment, the rotator 30 is mounted or otherwise attached along the circumference 215 formed at the outer radial distance 214 of the handle member 211 such that the rotator axis of rotation 38 is aligned substantially perpendicular to the diameter of the circular member 211.

Referring also to FIGS. 22A-22B, there is depicted a perspective view (FIG. 22A) and a top view (FIG. 22B) of a handle member 220 having a substantially circular tubular member 221 comprising a left side section forming a left side semicircular grip 222 and a right side section forming a right side semicircular grip 223, the circular member 221 having a diameter (not labeled). In this embodiment, a bracket 261 is mounted to the tubular member 221 across the diameter of the tubular member 221. Bracket 261 could be mounted across the inner diameter (as shown) or could be mounted along the outer diameter to the top face (not shown) of tubular member 221. A first end 229A of a rotator mount 229 is mounted or otherwise attached to bracket 261 in the middle point of the bracket (which also is the midpoint of the diameter of the circular tubular member 221). A rotator member 30 is mounted or otherwise attached to a second end 229B (opposite the first end 229A) of rotator mount 229 so that the axis of rotator rotation 38 is substantially perpendicular to the diameter of the circular tubular member 221. The height of rotator mount 229 is sufficiently high to permit clearance between the rotator axel 36 and the user's hands so that the strap 40 can rotate in its orbital pattern 14 without obstruction from the handle 221 or the user's hands on the handle 221. In an alternative embodiment, the bracket 261 could be concavely shaped (or the like) to provide a bracket-mounted caster to be mounted directly to the bracket 261 while also providing necessary clearance to permit the orbital path 14 to remain clear of user's hands during use of the device 10.

Figure 19A:
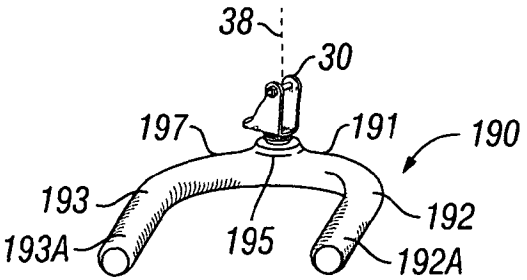
FIG. 19A depicts a perspective view of an exercise device handle according to an embodiment of the present invention.
Figure 19B:
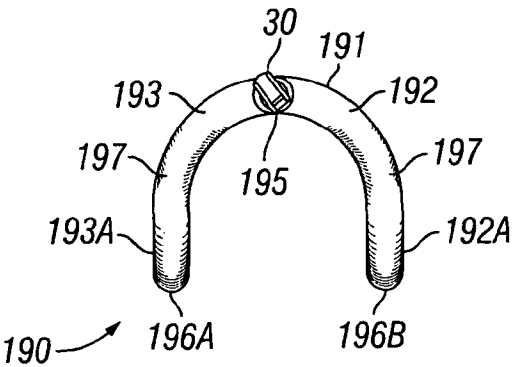
FIG. 19B depicts a top view of the exercise device handle of FIG. 19A.

Referring now to FIGS. 19A-19B, there is depicted a perspective view (FIG. 19A) and a top view (FIG. 19B) of a handle member 190 having a substantially semicircular tubular member 191 comprising a left side section forming a left side semicircular grip 192 (which, as depicted, may, if desired, have a linear extension 192A) and a right side section forming a right side semicircular grip 193 (which, as depicted, may, if desired, have a linear extension 193A). When held and used by the user over the user's head, the handgrips 193, 192 lie in a substantially horizontal plane substantially parallel with the ground. In this embodiment, the rotator 30 is mounted or otherwise attached at the midpoint 195 between points 196A and 196B along the top edge 197 of the semicircular tubular member 191 such that the rotator axis of rotation 38 remains substantially vertically and intersects substantially perpendicularly the horizontal plane in which handgrips 193, 192 reside.

Figure 20A:
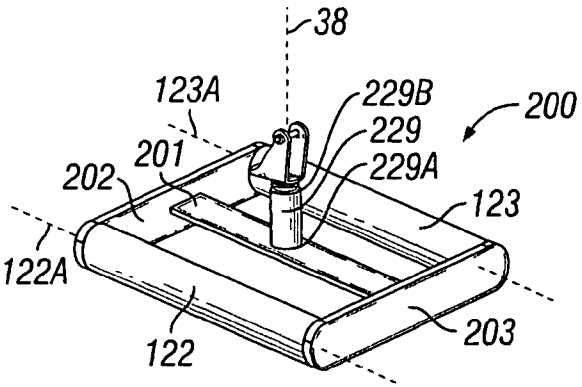
FIG. 20A depicts a perspective view of an exercise device handle according to an embodiment of the present invention.
Figure 20B:
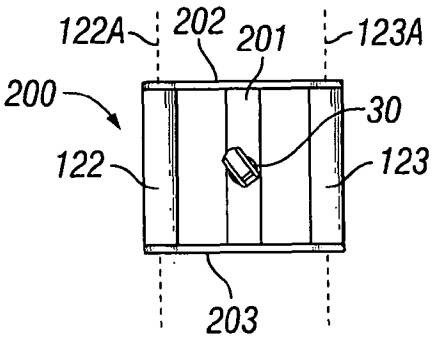
FIG. 20B depicts a top view of the exercise device handle of FIG. 20A.

Referring also to FIGS. 20A-20B, there is depicted a perspective view (FIG. 20A) and a top view (FIG. 20B) of a handle member 200 having a left handgrip 122, a right handgrip 123 parallel to and opposed by a desired distance from the left handgrip 122. The handgrips 122, 123 are secured in place by mounting one end to a first plate 202 and the other end to a second plate 203. Disposed equally between and parallel to the handgrips 122, 123 is a bracket 201 attached at its ends to plates 202, 203. A first end 229A of a rotator mount 229 is mounted or otherwise attached to bracket 201 in the middle point of the bracket. A rotator member 30 is mounted or otherwise attached to a second end 229B (opposite the first end 229A) of rotator mount 229 so that the axis of rotator rotation 38 is substantially perpendicular to the plane in which the handgrip axes 122A, 123A lie. The height of rotator mount 229 is sufficiently high to permit clearance between the rotator axel 36 and the user's hands so that the strap 40 can rotate in its orbital pattern 14 without obstruction from the user's hands on the handgrips 122, 123. In an alternative embodiment, the bracket 201 could be concavely shaped (or the like) to provide a bracket-mounted caster to be mounted directly to the bracket 201 while also providing necessary clearance to permit the orbital path 14 to remain clear of user's hands during use of the device 10.

Referring now to FIG. 24 there is shown a handle member 240 having a left handgrip 241, and a right handgrip 242 aligned axially along handle axis 243. A first end 229A of a rotator mount 229 is mounted or otherwise attached to handle 240 in the middle point of between handgrips 241, 242. A rotator member 30 is mounted or otherwise attached to a second end 229B (opposite the first end 229A) of rotator mount 229 so that the axis of rotator rotation 38 is substantially perpendicular to the handgrip axis 243. The height of rotator mount 229 is sufficiently high to permit clearance between the rotator axel 36 and the user's hands so that the strap 40 can rotate in its orbital pattern 14 without obstruction from the user's hands on the handgrips 241, 242.

Referring now to FIG. 25 there is shown a handle member 250 having a left handgrip 251, and a right handgrip 252 aligned axially along handle axis 252. A first end 229A of a rotator mount 229 is mounted or otherwise attached to handle 250 in the middle point of between handgrips 241, 242. A first rotator member 30A is mounted or otherwise attached to a second end 229B (opposite the first end 229A) of rotator mount 229 so that the axis of rotator 30A's rotation 38 is substantially perpendicular to the handgrip axis 253. The height of rotator mount 229 is sufficiently high to permit clearance between the rotator 30A's axel 36 (where strap 40 attaches) and the user's hands so that the strap 40 can rotate in its orbital pattern 14 without obstruction from the user's hands on the handgrips 251, 252. A second rotator 30B is mounted on the end of one of the grips, e.g., 252, such that the axis of rotator 30B's rotation is coaxial with handle axis 253. In this embodiment, the strap 40 can be attached to either rotator 30A or rotator 30B depending on the hand hold preferred by the user.

In each of the above-described handle embodiments, the exterior surface of the handle could be covered with a desired hand grip material such as those described herein. Additionally, the structural components could be solid or hollow, and made of any suitable material, such as metals, composites, plastics and the like. As can be seen from the foregoing disclosure, the handle configurations can be varied. There are shown a sampling of different handle embodiments that employ separate left hand grips and right hand grips that are attached to a handle housing that houses a rotator member that could be similar in operation to the caster-type rotator 30 noted earlier in connection with FIG. 2, e.g., by permitting rotational movement about the rotator axis 38. Some of the designs disclosed herein permit the user's hands to hold the grip in a more natural, or ergonomic, biomechanical position. Some of the designs employ handles that are aligned coaxially with the rotator axis of rotation (see, e.g., FIG. 2) or in parallel with the rotator axis (see, e.g., FIGS. 12A-B, 13A-B, 16A-B, 17A-B). Other designs employ handles that are oriented perpendicular to the rotator axis (see, e.g., FIGS. 19A-B, 20A-B, 22A-B, 24, 25). Still other designs employ handles that are oriented in the same vertical plane beneath the rotator (see, e.g., FIGS. 14A-B, 15A-B, 16A-B, 17A-B, 18A-B, 21A-B), while other designs employ handles that deviate from the vertical plane beneath the rotator (see, e.g., FIGS. 12A-B, 13A-B, 19A-B, 20A-B, 22A-B, 23A-B). Some of the designs employ handle sections that are substantially linear, while other designs employ handles that have longitudinal curvature or angularity. In yet another embodiment, the handle is circular or semicircular. In yet another embodiment, the handles are separate rings joined by a housing member containing the rotator.

Referring to FIGS. 2-11, a first end 41 of a strap 40 is clipped or otherwise attached onto the rotational attachment 30, by e.g., attaching to axel 36. In a preferred embodiment, the strap is constructed from 1" wide nylon or polypropylene strap material and has an overall length of 30 inches, but other lengths and other materials, such as cotton, leather, or synthetic material such as that used in heavy duty strapping, mountain climbing equipment, parachutes, etc. can be employed. In an alternate embodiment, the strap is outfitted with length adjustment devices much like the strap adjustment devices employed on backpacks and belts (a buckle mechanism 46 is shown as an example in FIG. 9). In a preferred embodiment, the strap is of an adjustable length. In a preferred embodiment, the strap first end 41 is sewn or otherwise attached back upon itself to create a small strap first end loop 43—the sewing preferably being double row stitched, but other forms of attachment can be employed such as, for example, by gluing, riveting and the like. The second end 42 of the strap 40 provides another similarly created loop 44 for attaching to the external bag member 50. To facilitate attachment of the second end 42 of the strap 40 to the external bag member 50, any number of connectors 45 (45A, 45B, 45C) known in the art could be used, such as, for example, asymmetric spring clips, chain connectors, quick links, carabiners, snap links, chain snaps, spring clips with or without screw locks, snap hooks, wide asymmetric clips, metal loop carabiner with sprung or screwed gate, oval or triangular shaped locking carabiners, or other carabiner style fasteners, such as screw gate carabiners or locking carabiners. Representative connectors can be obtained from Keystone Mfg. & Supply Co. (Allentown, Pa.) and on the internet from, e.g., Bosunsupplies.com.

In another preferred embodiment, the strap member 40 has a metal grommet (not shown) mounted on each strap end 41, 42. In this embodiment, the strap 40 can be attached at one end to the rotator member 40 by using a clip device 45 of the variety described above by securing the clip device (not shown) through the strap grommet (not shown) to the rotator (e.g., to the rotator axel 36). Similarly, the opposing strap end can be attached to the external bag member 50 by using a clip device of the variety described above by securing the clip device 45 through the strap grommet (not shown) and through the external bag grommets 51 (e.g., made of brass). In yet another embodiment, the external bag 50 can be outfitted with fastener loops (not shown) near the top edge of each side of the bag 50 so that when finished using the device for exercising, the strap 40 can be attached to the fastener loops (not shown) on the bag 50 so that the bag can be carried by hand or on the user's shoulder, and wherein the handle 20 (or others) and internal weight bags 60, 60A (preferably now empty) can be stowed. Alternatively, the strap clips could both be secured to the external bag grommets 51 to permit the strap 40 to serve as a convenient carrying handle.

Figure 7:
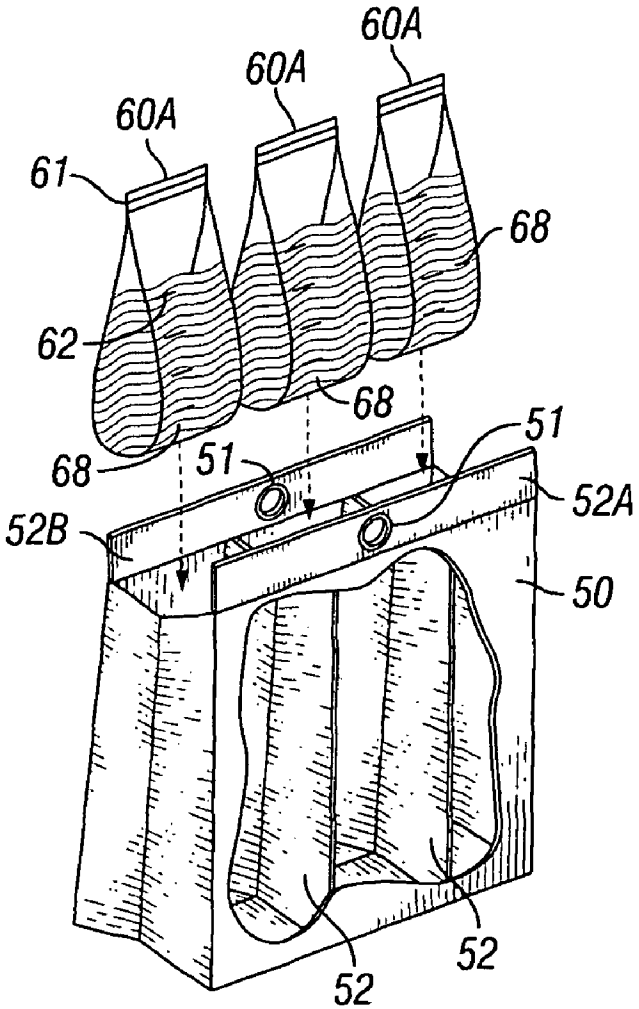
FIG. 7 depicts an exercise device weight bag according to an embodiment of the present invention.
Figure 6:
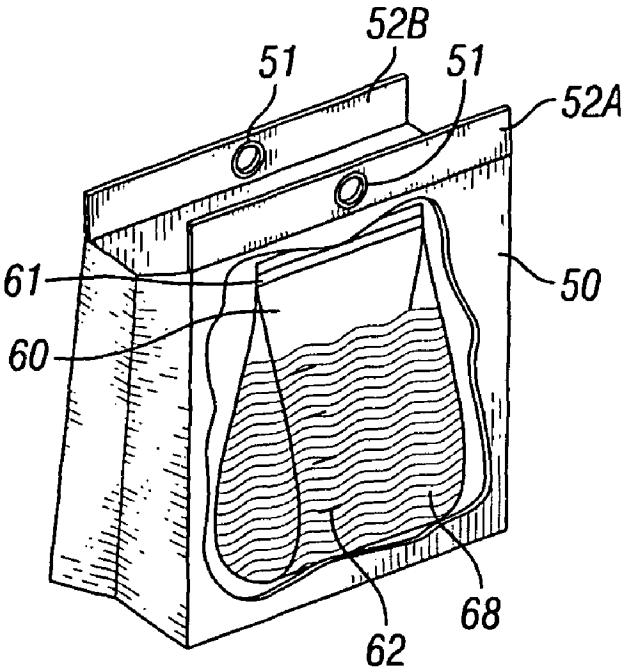
FIG. 6 depicts an exercise device weight bag according to an embodiment of the present invention.
Figure 9:
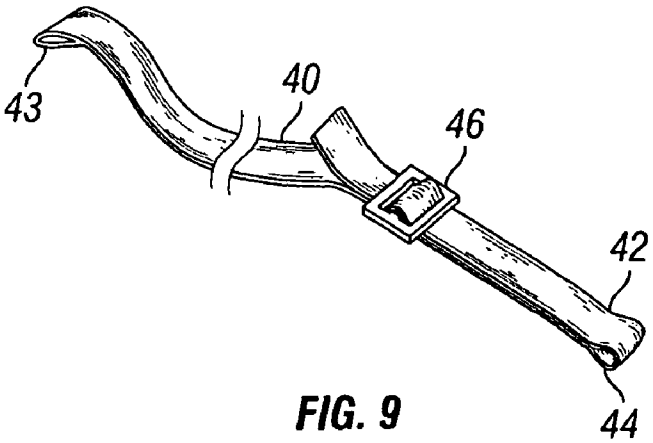
FIG. 9 depicts an exercise device strap according to an embodiment of the present invention.
Figure 10:
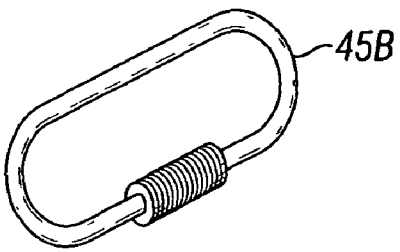
FIG. 10 depicts an exercise device connector according to an embodiment of the present invention.
Figure 8:
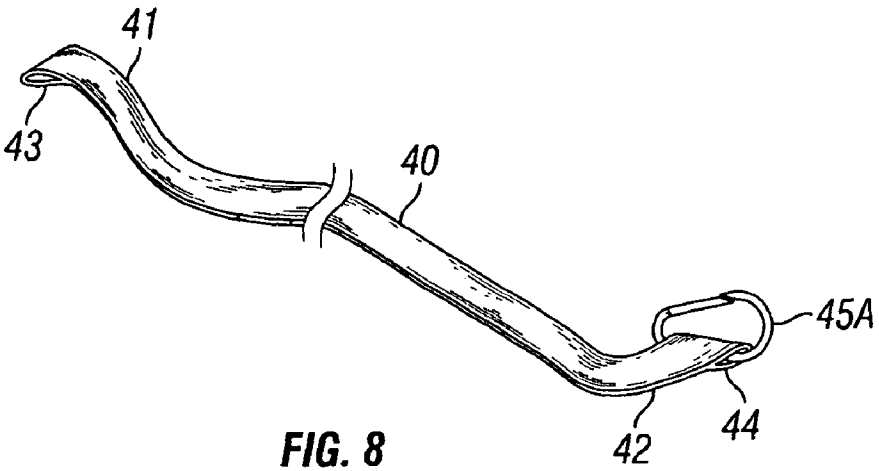
FIG. 8 depicts an exercise device strap according to an embodiment of the present invention.

The soft bag 50, preferably of a heavy duty cloth or synthetic fiber construction, such as nylon, or heavy duty canvas, is capable of holding one or more water-finable plastic bags 60, 60A, such as 2 mil clear reclosable bags outfitted with the zipper style locking system or the sliding locking system 61, such as those offered under the ZIPLOC® trademark. In another preferred embodiment, the soft bag 50 is outfitted with two metal (e.g., brass) circular grommets 51 on opposed top edges of the sides of the soft bag, the grommets capable of receiving the strap clip connector 45. In a preferred embodiment, the soft bag 50 is capable of holding about one gallon of water (either directly or by housing a container(s) holding such amount(s) of water). Preferably, the soft bag 50 upper edges 52A, 52B are of reinforced thickness (i.e., double thickness) to create more support for the grommets 51. In yet another embodiment, the soft bag 50 has its own carrying handle or handles (not shown) that can be attached to the strap clip to fasten the soft bag to the strap. In still another preferred embodiment, the external bag 50 is gusseted. When the strap clip is clipped through the grommets, it serves to close the soft bag 50 opening thereby containing the water-fellable plastic bag(s) 60, 60A within the soft bag 50. In a preferred embodiment, the water-fillable plastic bags 60, 60A are equipped with a sealable opening 61 to permit containment of the water 68 in sealed fashion. In another preferred embodiment, the soft bag itself is capable of being filled with a desired amount of water and can, if desired, itself be outfitted with a reclosable seal such as of the zipping lock or sliding lock variety. In yet another preferred embodiment, the one or more internal bag members 60, 60A employed can be marked with volume/weight gradation markings 62 to permit the using to readily know what volume or approximate weight of water is being used. Additionally, the internal bag members 60, 60A can also be provided in varying sizes and shapes to permit the user with flexibility to incrementally add more weight by either selecting a larger volume internal bag 60 or by adding an additional internal bag 60 filled with the desired incremental additional amount of water. Likewise, the user can remove water weight incrementally by removing smaller water filled bags from the soft bag 50. In an alternative embodiment, the soft bag 50 can receive one or more finable water containers, such as, for example, plastic water bottles, plastic milk jugs, water refillable exercise weights, such as the AQUABELLS® brand travel dumbbell weights, and the like. Referring to FIG. 7, in yet another embodiment of the present invention, the soft bag 50 contains one or more internal partitions 52 to house smaller water finable bags 60A. FIGS. 6 and 7 show a partial cutaway view of external bag 50.

When used, the present invention provides a compact, portable, centripetal force-driven exercise device. One advantage of the present invention is that it does not require a great deal of space or "footprint" to use. Thus, when in use, the user need only find an area that provides clearance for the user and the orbital pattern 14 achieved by the swinging bag 50. As with any weight training or exercise device, care should be used during use to ensure that the appropriate clearance from objects and other persons is achieved. By providing the preferred zippered or slidably reclosable plastic water-filled bags 60 in the interior of the bag 50, any impact of the rotating bag upon an object or person will be lessened in that the plastic bag seals 61 will burst open to permit the water to disperse thereby lessening any impact. When not in use, the compact nature of the external bag 50, and internal bag(s) 60, 60A when empty, makes for easy transportation and storage. Also, where the handle 20 is of a short, stick shape, such as shown in FIG. 2, the handle also remains very compact for easy transportation and storage.

All references referred to herein are incorporated herein by reference. While the apparatus and methods of this invention have been described in terms of preferred embodiments, it will be apparent to those of skill in the art that variations may be applied to the process and system described herein without departing from the concept and scope of the invention. All such similar substitutes and modifications apparent to those skilled in the art are deemed to be within the scope and concept of the invention. Those skilled in the art will recognize that the method and apparatus of the present invention has many applications, and that the present invention is not limited to the representative examples disclosed herein. Moreover, the scope of the present invention covers conventionally known variations and modifications to the system components described herein, as would be known by those skilled in the art. While the apparatus and methods of this invention have been described in terms of preferred or illustrative embodiments, it will be apparent to those of skill in the art that variations may be applied to the process described herein without departing from the concept and scope of the invention. All such similar substitutes and modifications apparent to those skilled in the art are deemed to be within the scope and concept of the invention.

I claim:

1. A portable, centripetal force-driven exercise device comprising:

a. a handle capable of being gripped by a user;

b. a rotating member fixably attached to said handle and having an axis of rotation;

c. a strap member having a first strap end attached to said rotating member and a second strap end opposite the first strap;

d. an external bag member capable of being attached and detached from said second strap end, and capable of receiving one or more liquid containers capable of receiving and holding water therein, and capable of releasing said water therefrom;

e. one or more liquid containers capable of receiving and holding water therein, and capable of releasing said water therefrom, said one or more liquid containers sized to be containable within said external bag member;

f. said handle further comprises a hollow shaft; and g. said rotating member further comprises a caster-type swivel mechanism comprising a stationary end having a mounting stem for attaching to said handle, a rotating end rotatingly attached to said stationary end, rotator bearings to permit smooth rotation of the rotating end, and an axle for receiving said first strap end in an attached relationship, wherein said mounting stem is mounted within said hollow shaft and fixed in place using a locking dimple, wherein said locking dimple extends perpendicular to the axis of rotation.

2. The exercise device of claim 1, wherein said one or more liquid containers comprise one or more internal bag members.

3. The exercise device of claim 2, wherein said one or more internal bag members comprise reclosable plastic bags outfitted with a zipper locking system.

4. The exercise device of claim 1, wherein said handle is selected from the group consisting of: mono-axially oriented handles where the user places one hand on top of the other, mono-axially oriented handles where the user places each hand side-by-side, parallel bi-axially oriented handle pairs where the user holds each respective handle pair with each hand's thumb in an upward position, non-parallel bi-axially oriented angled handle pairs where the user holds each respective handle pair with each hand's thumb in an upward position, semi-circular handle pairs, circular handle, and U-shaped handle pairs.

5. The exercise device of claim 1, wherein said handle is selected from the group consisting of: handles aligned coaxially with the axis of rotation, handles aligned in parallel with the axis of rotation, handles that are oriented perpendicular to the axis of rotation, handles that are oriented in the same vertical plane beneath said rotating member, handles that deviate from the vertical plane beneath said rotating member, handle sections that are substantially linear, handles that have longitudinal curvature or angularity, handles that are circular or semicircular, handles that are separate rings joined by a housing member containing the rotating member, and ergonomically designed handles.

6. The exercise device of claim 1, wherein said handle further comprises a grip material on at least a portion of the exterior surface of said handle.

7. The exercise device of claim 6, wherein said grip material is selected from the group consisting of: a one-piece rubber sleeve that is placed over the outside of the handle, injection molded grip made from high quality thermo plastic rubber (TPR), other soft elastomeric materials, leather, and grip tapes.

8. A portable, hand-held exercise device comprising:

a. a hollow core, linear handle capable of being gripped by a user, said handle having a top end and a bottom end, a handle central axis running through said hollow core from said bottom end to said top end, and a grip material on at least a portion of the exterior surface of the handle;

b. a swiveling member mechanically attached to said top end of said handle and capable of rotating 360 degrees about said handle central axis, the swiveling member comprising a stationary end having a mounting stem for attaching to said handle, a rotating end rotatingly attached to said stationary end, and one or more rows of ball bearings to permit smooth rotation of the rotating end, wherein said mounting stem is mounted within said hollow core and fixed in place using a locking dimple, wherein said locking dimple extends perpendicular to the central axis;

c. a strap member having a first strap end attached to said swiveling member and a second strap end opposite the first strap end, the swiveling member further comprising an axel for receiving the first strap end in an attached relationship;

d. an external bag member capable of being attached and detached from said second strap end, and capable of receiving one or more internal bag members; and e. one or more internal bag members capable of being filled with a desired quantity of water to provide a desired weight resistance prior to use of the exercise device by the user, and capable of being emptied of said water therefrom after use by the user, said one or more internal bag members being sized to be containable within said external bag member.

9. The exercise device of claim 8, wherein said grip material is selected from the group consisting of: a one-piece rubber sleeve that is placed over the outside of the handle, injection molded grip made from high quality thermo plastic rubber (TPR), other soft elastomeric materials, leather, and grip tapes.

10. The exercise device of claim 8, wherein said handle is made from the group consisting of: metal, plastic, composite, graphite and other suitable material.

11. The exercise device of claim 8, wherein said one or more internal bag members comprise reclosable plastic bags outfitted with a zipper locking system to facilitate easy filling and emptying, and also to permit the one or more bag members to readily burst open upon impact thereby minimizing any injury to person or property owing to such impact.

* * * * *